US007273414B2

(12) United States Patent
Nagao et al.

(10) Patent No.: US 7,273,414 B2
(45) Date of Patent: Sep. 25, 2007

(54) RACE GAME DEVICE

(75) Inventors: Yuji Nagao, Tokyo (JP); Takanori Akiyama, Tokyo (JP); Naoki Kawajiri, Tokyo (JP); Seiji Hayashi, Tokyo (JP); Susumu Murata, Tokyo (JP); Koji Yamaguchi, Tokyo (JP); Yuji Ikeda, Tokyo (JP); Mitsuru Todaiji, Tokyo (JP); Yasuhiro Takagi, Tokyo (JP); Shunichi Nakamura, Tokyo (JP); Keiji Yano, Tokyo (JP); Muneoki Kamata, Tokyo (JP); Shingo Kataoka, Tokyo (JP); Koji Osuka, Tokyo (JP)

(73) Assignee: Sega Enterprises, Ltd., Tokyo (JP)

( * ) Notice: Subject to any disclaimer, the term of this patent is extended or adjusted under 35 U.S.C. 154(b) by 52 days.

(21) Appl. No.: 10/133,344

(22) Filed: Apr. 29, 2002

(65) Prior Publication Data

US 2002/0165017 A1 Nov. 7, 2002

Related U.S. Application Data

(63) Continuation of application No. 09/043,927, filed as application No. PCT/JP97/02678 on Aug. 2, 1997, now Pat. No. 6,394,898.

(30) Foreign Application Priority Data

Aug. 2, 1996 (JP) ..... 8-204735
Jul. 14, 1997 (JP) ..... 9-188738

(51) Int. Cl.
*A63F 13/00* (2006.01)

(52) U.S. Cl. ..... 463/6; 463/30; 463/25

(58) Field of Classification Search ..... 463/1, 463/6, 59–62, 25, 30; 273/246
See application file for complete search history.

(56) References Cited

U.S. PATENT DOCUMENTS 3,630,524 A * 12/1971 Cooper ..... 273/86 R
5,320,351 A * 6/1994 Suzuki ..... 273/86 B
5,411,258 A * 5/1995 Wilson et al. ..... 273/86 B
5,687,968 A * 11/1997 Tarantino ..... 273/139
5,770,533 A * 6/1998 Franchi ..... 463/42
5,777,605 A * 7/1998 Yoshinobu et al. ..... 463/37

OTHER PUBLICATIONS

CharlesTown Races "How to have a good Night" dated Jun. 24, 1979.*

How to read Racing form Past performences © Daily racing Form Inc dated Jun. 27, 1979.*

* cited by examiner

*Primary Examiner*—Mark Sager
*Assistant Examiner*—Robert Mosser
(74) *Attorney, Agent, or Firm*—Dickstein Shapiro LLP

(57) ABSTRACT

A loop track for racing objects is disposed at the center of a race game device, for example for a simulated horse race. A plurality of racing objects, such as race horses, run on the track. The X- and Y-directional positions of the race horses are detected by a separable position detecting means underlying the track. The separable position detecting means allows for easier maintenance, transport, assembly, and disassembly of the device. Information regarding the positions of the horses is displayed on a game screen. Players can write memos to themselves on individual game screens by pressing a trace over the game information on the game screen. A control unit provides game information corresponding to other races other than a current race, including future races, and players may select information corresponding to future races on the individual game screen.

3 Claims, 32 Drawing Sheets

FIG. 4

CHANNEL

SPEAKER

| | 1 | 2 | 3 | 4 | 5 | 6 | 7 | 8 | 9 | 10 | 11 | 12 |
|---|---|---|---|---|---|---|---|---|---|---|---|---|
| SP1 | | | | | 1 | 4 | | | | | | |
| SP2 | | 4 | 8 | | | 12 | | | | | | |
| SP3 | 8 | 12 | 16 | | | 8 | | | | | | |
| SP4 | 12 | 4 | 4 | | | | | | | | | |
| SP5 | 1 | | | | | | | | | | | |
| SP6 | | | | | | | | | | | | |
| SP7 | | | | | | | | | | | | |
| SP8 | | | | 4 | | | | | | | | |
| SP9 | | | | 12 | 8 | | | | | | | |
| SP10 | | | | 4 | 16 | | | | | | | |
| SP11 | | | | 1 | 8 | | | | | | | |
| SP12 | | | | | 2 | 1 | | | | | | |

RACE GAME DEVICE

This application is a continuation of U.S. patent application 09/043,927 now U.S. Pat. No. 6,394,898 entitled RACE GAME DEVICE, filed Jul. 29, 1998, which is a 35 U.S.C. 0371 application of international application number PCT/JP97/02678, filed Aug. 2, 1997. Priority is claimed to Japanese patent applications 8-204735/1996, filed Aug. 2, 1996, and 9-1887738/1997, filed Jul. 14, 1997. The entirety of each of the foregoing applications is hereby incorporated by reference.

TECHNICAL FIELD

The present invention relates to a race game device for playing a game by anticipating the winning places of moving objects, such as model horses, model cars or others, which are to be run on a track in a model horse race, model boat race, model car race, an auto race or others.

BACKGROUND ART

There have been conventionally many kinds of race game devices for model horse races, boat races, car races, auto races, etc. In the conventional race devices, moving objects, such as model horses, model cars, etc., are run on loop courses to compete for winning place or to anticipate winning places. In these race games, however, the moving objects can be run only on preset loop tracks, which cannot help making the games less realistic and less amusing.

To make such race games more realistic, the applicant of the present application has filed a patent application (Japanese Patent Laid-Open Publication No. Sho 63-094884/1988) on an epoch-making race game device in which moving objects can be run on free courses on a field in place of set loop courses. In the race game device, moving objects, such as model horses, can be run freely on the field, which permits development of the race as in actual horse races. Thus, the race game device can make the game realistic and is popular among game players.

The applicant of the present application has further improved the above-described race game device so that a larger number of moving objects can race at once, and realistic, amusing races, such as horse races, boat races, etc., are made possible. As a result, an innovative race game device which enables winning place anticipation and realistic race developments to be enjoyed has been realized.

An object of the present invention is to provide a race game device which permits a larger number of moving objects to be run at once.

Another object of the present invention is to provide a race game device which enables realistic race developments to be enjoyed.

Further another object of the present invention is to provide a competing game device which has contrived lighting for a race to thereby successfully make the race impressive.

DISCLOSURE OF THE INVENTION

The above-described objects are achieved by a race game device for racing moving objects on a field, comprising: position detecting means disposed on the field for the moving objects to be raced on for detecting positions of the moving objects, the position detecting means being separable in a plurality of members along preset parting lines;

and connection means for connecting said a plurality of members at the preset parting lines.

The above-described-objects are achieved by a race game device for racing moving objects on a field, comprising: sound generating means disposed on reset positions along running track of said a plurality of moving objects on the field; and sound generation control means for generating running sounds of the moving objects from the sound generating means, based on the preset positions of the sound generating means and on the positions of the moving objects.

The above-described objects are achieved by a race game device for racing moving objects on a field, comprising: a plurality of photo signal generating means disposed at preset positions along a running course of the moving objects on the field, said a plurality of photo signal generating means outputting photo signals to the moving objects.

The above-described objects are achieved by a race game device for racing moving objects on a field, comprising: photo signal outputting means disposed on each of the moving objects; and photo signal detecting means disposed at preset positions along a running track for the moving objects on the field, photo signals from the photo signal outputting means of the moving objects being detected by the photo signal detecting means.

The above-described objects are achieved by a race game device for racing moving objects along a field, comprising: light emitting means for outputting light from an upper surface or a side of the field, the light emitting means outputting light corresponding to the racing of the moving objects on the field.

The above-described objects are achieved by a race game device for racing moving objects on a field, comprising: a game screen for displaying game information to a player, the player pressing the game screen to display a trace of the pressing over the game information on the game screen.

The above-described objects are achieved by a race game device for racing moving objects on a field, comprising: a game screen for displaying game information to a player; storing means for storing information corresponding to a plurality of races which are to be held, race information selected by the player out of the information of said a plurality of races stored in the storing means being displayed on the game screen.

The above-described objects are achieved by a race game device for racing running objects on a field, comprising: a start gate for a plurality of the running objects to be aligned at, gates of the running objects being opened when a race is started.

The above-described objects are achieved by a race game device for racing running objects on a field, comprising: motors for running the moving objects, diagnosing means for diagnosing states of the motors, and photo signal outputting means for outputting as photo signals results of the diagnoses made by the diagnosing means which are included with the respective moving objects; photo signal detecting means disposed at preset positions along a running track for the moving objects on the field, photo signals from the photo signal outputting means of the running objects being detected by the photo signal detecting means.

The above-described objects are achieved by a race game device for racing moving objects on a field, comprising: motors for running the moving objects, and drive control means for controlling drive of the motors to move the moving objects forward and backward.

The above-described objects are achieved by a race game device for racing running objects on a field, comprising:

motors for running the running objects, and drive control means for PMW (Pulse Width Modulation) controlling the motors.

The above-described objects are achieved by a race game device for racing moving objects on a field, comprising: light irradiating means for irradiating light to the field from above the field; light irradiation control means for controlling light irradiated by the light irradiating means in accordance with a running state of the movable objects.

The above-described objects are achieved by a game device in which a plurality of game players participate to play, comprising: a plurality of operation units operated by said plurality of game players; and an electric power source unit for supplying electric power to said a plurality of operation units, each of the operation units including: an electric power source switch for turning on and off electric source power from the electric power source unit; a door switch interlocked with opening/closure of a door; and means for breaking the electric source power, based on a state of the door switch.

The above-described objects are achieved by a game device in which a player participates to play, comprising: n operation unit operated by the player, the operation unit including: a medal outlet for paying medals; and a medal container disposed on the medal outlet, for receiving the medals.

According to the present invention, a race game device which can race a larger number of moving objects at once and which can make race developments more amusing can be realized.

BRIEF DESCRIPTION OF THE DRAWINGS

FIG. 4 is a view of an example of sound volumes of sound sources for the respective speakers of the hoofbeat generating unit.

BEST MODES FOR CARRYING OUT THE INVENTION

FIRST EMBODIMENT

A horse race game device according to a first embodiment of the present invention will be explained with reference to the drawings.

(General Appearance of Horse Race Game Device)

Figure 1:
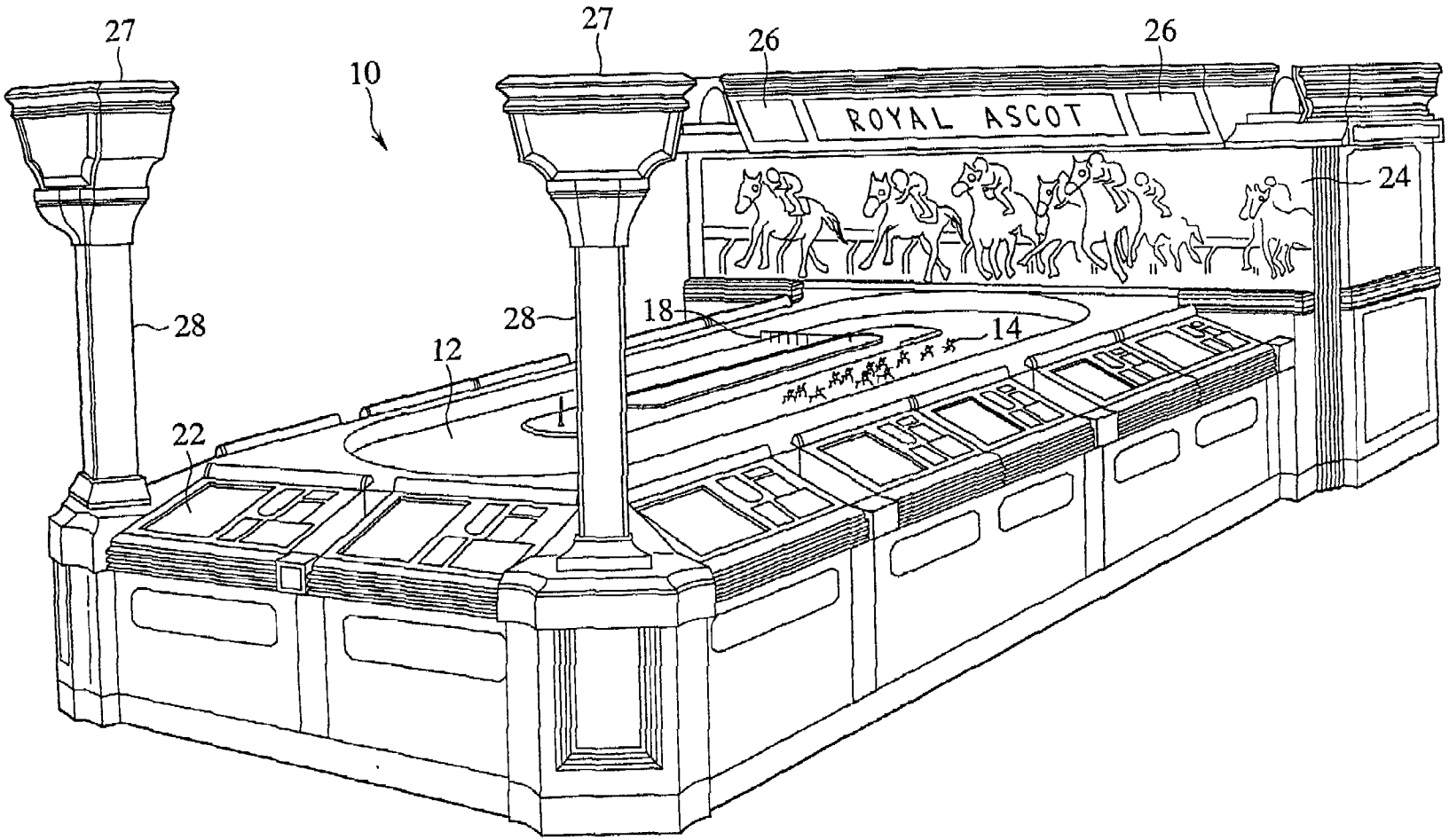
FIG. 1 is a view of a general appearance of the horse race game device according to a first embodiment of the present invention.

A general appearance of the horse race game device is shown in FIG. 1.

A horse race loop track 12 is provided at the center of the horse race game device 10. Twelve model horses 14 are run on the track 12. A gate 18 is provided on the track 12 and is advanced to a start point on the track 12 when a race is started.

On three sides of the track 12 there are provided twelve satellites 22. Ten of the 12 satellites are disposed on each of the longer sides of the track 12, five on each side, and two of the 12 satellites are disposed on one of the shorter sides of the track 12.

A large projector which displays images of the developments of a horse race is provided on the other of the shorter sides of the track 12. On both sides of the large projector 24 there are disposed speakers 26 for live broadcast, output of fanfares, background music, etc. On both ends of said one shorter side of the track 12 there are disposed pillars 28 which accommodate speakers 27.

(General Constitution of the Horse Race Game Device)

Figure 2:
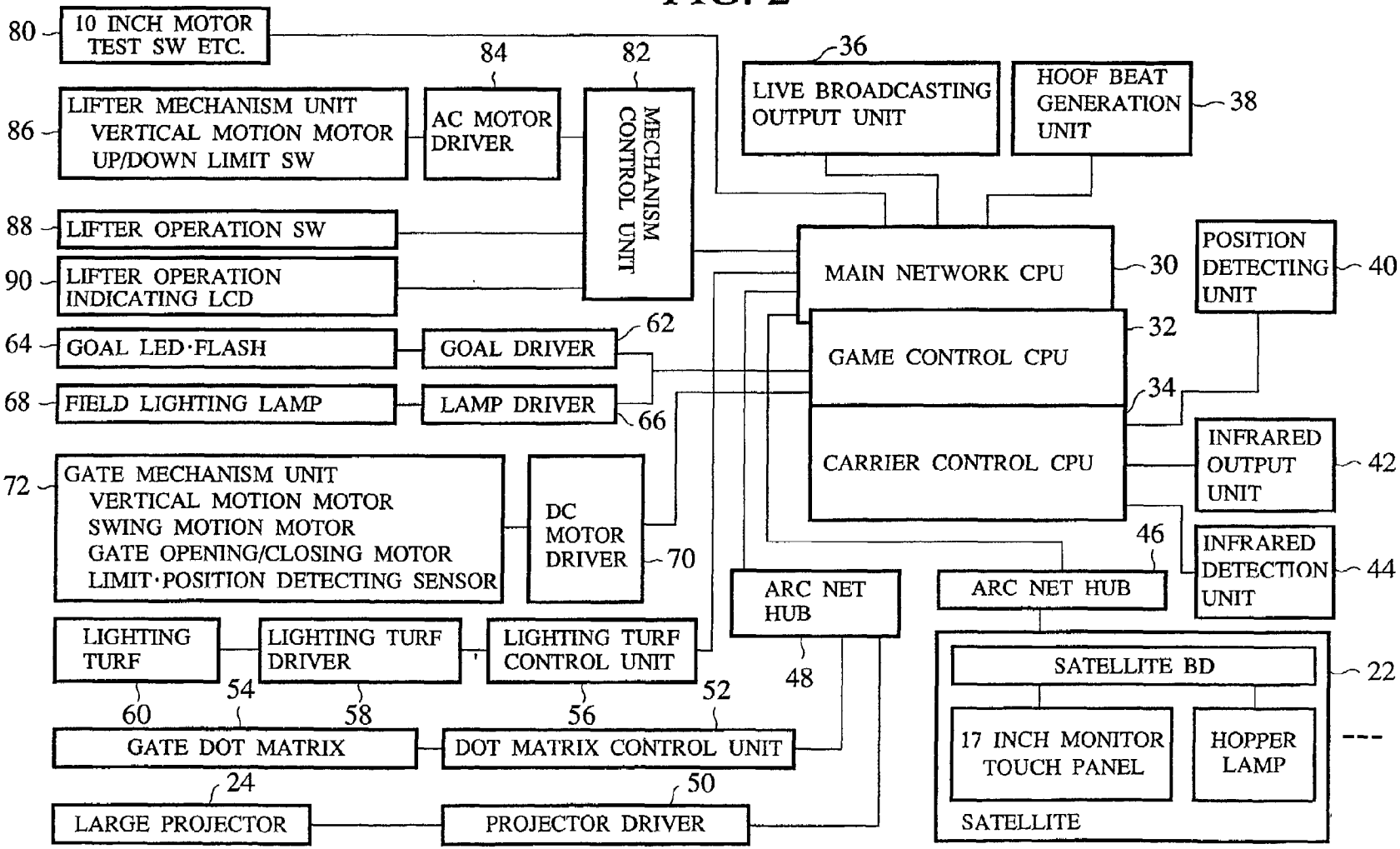
FIG. 2 is a block diagram of a general constitution of the horse race game device according to the first embodiment of the present invention.

A general constitution of the horse race game device is shown in FIG. 2.

A main network CPU 30 generally controls the horse race game device, and conducts main control of a horse race game, including administration of registered race horses, decision on the race program, decision of entry horses, decision of odds, race anticipation, administration of players' bets, lots for the first and the second places, decision of allotments, settlement of refunds, rewrite of registered horse data, etc.

A game control CPU 32 conducts basic control for execution of a horse race, including decision of developments of the horse race, control of a gate mechanism, control of goal LEDs, control of field illumination, etc.

A carrier control CPU 34 controls movements of the model race horses, and conducts main control, including detection of positions of the model race horses, commands to the model race horses, etc.

The main network CPU 30 is connected to a live broadcasting output unit 36. The broadcasting output unit 36 outputs live broadcasts of a race, fanfares, background music, results, etc., from the speakers 26 on both sides of the large projector 24 and from the speakers 27 in the pillars 28.

The main network CPU 30 is connected to a horse hoofbeat generation unit 38. The sound of hoofbeats corresponding to gaits of the model race horses is outputted from dome speakers disposed in the respective satellites 22 to thereby make the race realistic. The horse hoofbeat generation unit 38 will be detailed later.

The carrier control CPU 34 is connected to a position detecting unit 40 which detects positions of carriers, and correctly detects positions of the model race horses, based on oscillation signals outputted by the carriers carrying the model race horses. The track 12 must be large enough to accommodate twelve model race horses. In the present embodiment, the track 12 is divided into three parts to facilitate its installation. The position detecting unit 40 will be detailed later.

The carrier control CPU 34 is connected to an infrared output unit 42 which outputs command signals to the carriers. The infrared output unit 42 outputs infrared signals to give various command signals to the carriers. A number of infrared output units 42 are disposed in the track so that all the carriers in the track can detect the infrared signals.

The carrier control CPU 34 is connected to an infrared detection unit 44 which detects infrared signals from the carriers. In the present embodiment, CPUs are mounted on the respective carriers, so that, for example, states of electric power motors of the carriers can be detected by the respective CPUs. The carriers output results of the detection as infrared signals.

A plurality of the infrared detection units 44 may be disposed in the track, as may be a plurality of the infrared output units 42, but in the present embodiment the infrared detection unit 44 is disposed near the starting point, so that when the carriers are gathered at the starting point, command signals indicative of results of the detection of the carriers are outputted, and the detection results from the carriers are outputted as infrared signals. The infrared detection unit 44 detects infrared signals outputted by the carriers.

The main network CPU 30 is connected to an arc net HUB 46. The arc net HUB 46 is connected to the 12 satellites. Each satellite 22 includes a satellite BD, a 17-inch monitor, a touch panel, a casting switch, a hopper lamp, etc. The satellites 22 will be detailed later.

The main network CPU 30 is connected to an arc net HUB 48. The arc net HUB 48 is connected to the large projector 24 through a projector driver 50. The projector driver 50 drives the large projector 24. The large projector 24 displays the progress and developments of a race, announcements of races, race results, race live broadcasting, titles, etc.

The arc net HUB 48 is connected to a gate dot matrix 54 through a dot matrix control unit 52. The gate dot matrix 54 is disposed on an upper part of the gate and is constituted by 4 sheets of 16×32 dot matrix LEDs laterally arranged. The dot matrix control unit 52 controls display of the gate dot matrix 54. The gate dot matrix 54 displays entry horse numbers, kinds of horse races, horse names, track states, horses in upper placing (up to the fifth place) during a race, etc.

The main network CPU 30 is connected to light-emitting turf 60 through a light-emitting turf control unit 56 and a light-emitting turf driver 58. The light-emitting turf 60 comprises light a emitting body buried below the track 12. When the model race horses are run, the light-emitting body is actuated so as to make the model race horses appear speedy. The light-emitting law control unit 56 controls light-emission of the light-emitting turf 60, and the light-emitting turf driver 58 drives the light-emitting turf 60. The light-emitting turf 60 will be detailed.

The game control CPU 32 is connected to a goal LED/flash 64 through a goal driver 62 and to field lighting lamps 68 through a lamp driver 66. The goal driver 62 drives the goal LED/flash 64. The lamp driver 66 drives the field lighting lamps 68. The LED/flash 64 is disposed at the goal position of the track 12, and lights on and off or flashes when a model race horse arrives at the goal to lend an aspect of excitement to the race. The field lighting lamps 68 are disposed on the pillars 28 and are switched on to illuminate the track 12.

The game control CPU 32 is connected through a DC motor driver 70 to motors and a sensor included in a gate mechanism 72. The gate mechanism 72 includes a vertical motion motor for moving the gate up and down, a swing motion motor which swings the gate, a gate opening/closing motor which opens and closes the gate, and a limit/position detecting sensor which detects a limit position and other required positions of the gate. The gate mechanism 72 will be detailed later.

The main network CPU 30 is connected to various means for maintaining the horse race game device 10.

The main network CPU 30 is connected to a 10-inch motor 80. The 10-inch motor 80 includes a test switch necessary for maintenance operations. The 10-inch monitor 80 displays states of the respective units of the horse race game device 10, meter data and trouble indications.

The main network CPU 30 is connected to a mechanism control unit 82. The mechanism control unit 82 is connected to a lifter mechanism 86 through an AC motor driver 84 and to a lifter operation switch 88 and a lifter operation indicating LCD 90. The lifter mechanism 86 includes a vertical motion motor which moves the entire track up and down at the center, and an UP/DOWN limit switch which detects vertical limit positions.

When the lifter operation switch 88 is actuated, the entire track is moved up and down by the lifter mechanism 86. When the entire track is lifted upward, the carriers below the track 12 can be easily accessed for maintenance. States of the lifter motions are indicated by the lifter operation indication LCD 90.

For prohibiting accidents, when the entire track is moved up and down, the track is moved slowly with a buzzer set to ON. When the entire track is moved down, there is a danger that fingers may be caught, but when the entire track is moved up, because the danger of fingers being caught is rare, the entire track is moved up relatively fast so as to reduce maintenance time. The UP/DOWN limit switch prevents accidents due to erroneous operations.

(Hoofbeat Generation Unit)

Figure 3:
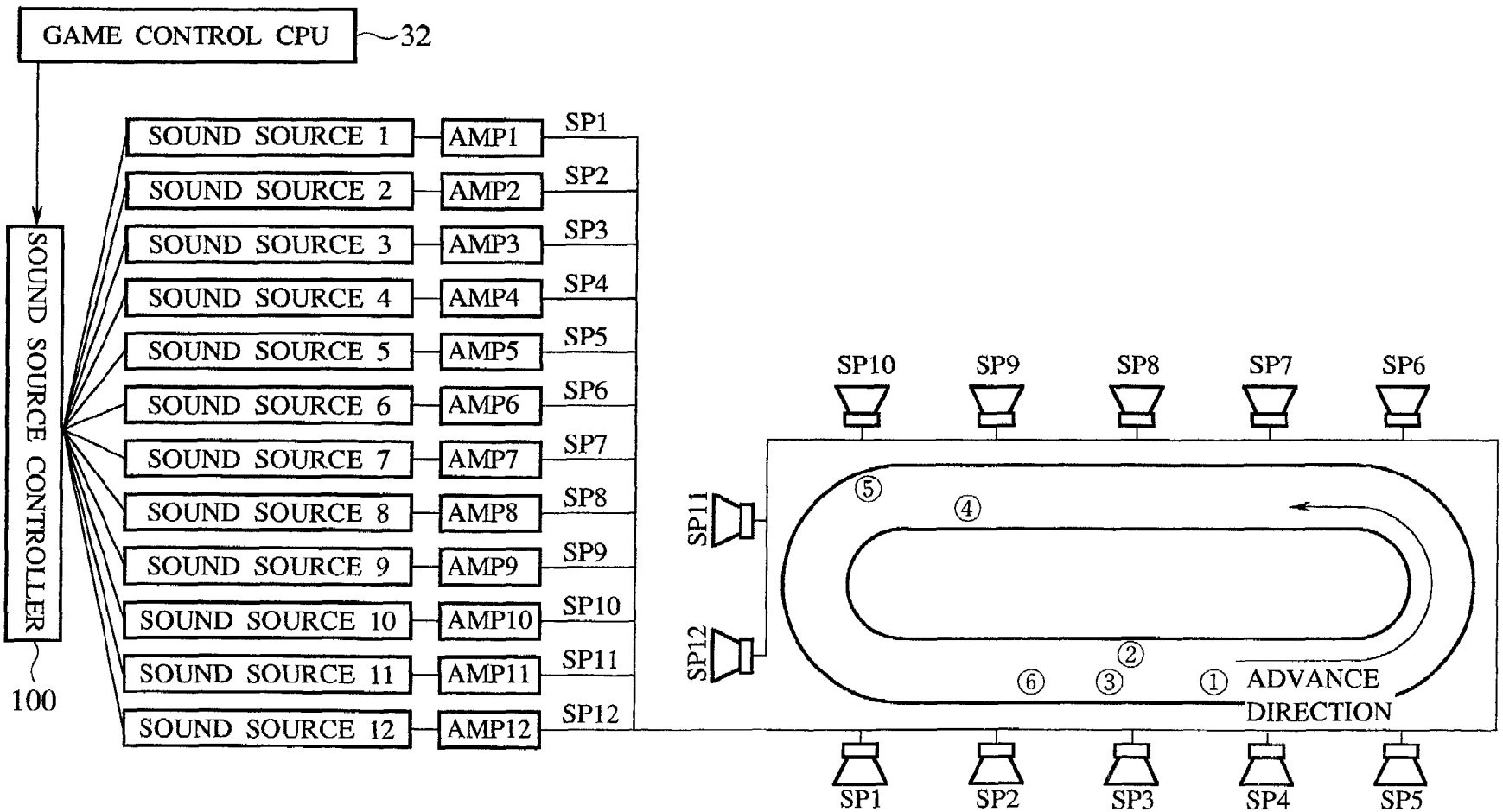
FIG. 3 is a view of a constitution of a hoofbeat generating unit of the horse race game device.

A constitution of the hoofbeat generation unit 38 of the horse race game device 10 is shown in FIG. 3.

The hoofbeat generation unit 38 of the present embodiment faithfully reproduces the sound of hoofbeats of actual race horses passing specters.

In the conventional horses race game device, to make hoofbeats, in place of sounding hoofbeats by a plurality of speakers, sound volumes of a plurality of speakers are adjusted to output the sound of the hoofbeats as if actual race horses were running along a track. However, it is impossible to effectively vary sounds corresponding to the development of a race only by adjusting sound volumes of a plurality of speakers. Invariably, the same sound effects result, for example, in a race in which all model race horses run in one group, as in a race in which a few model race horses lead, and the rest of the model race horses run in one group, or as in a race in which many model race horses lead in a group, and one or some model race horses run in a trailing group.

The hoofbeat generation unit 38 of the present embodiment overcomes this difficulty and can make realistic sound corresponding to race real-life developments.

Around the track 12 of the horse race game device 10 there are disposed twelve dome speakers SP1-SP12. To be specific, the twelve dome speakers SP1-SP12 are disposed respectively in the 12 satellites. Game players in the respective satellites can hear hoofbeats from their respective satellites.

The twelve speakers SP1-SP12 respectively include sound sources 1-12 and amplifiers AMP1-AMP12. The sound sources 1-12 are controlled by a sound controller 100. The sound controller 100 is connected to the game control CPU 32.

Channels for the number of entered race horses are allocated to each of the twelve sound sources 1-12. In the present embodiment, a maximum number of twelve race horses can enter, and as shown in FIG. 4, twelve channels are allocated to each of the twelve sound sources 1-12. The sound sources 1-12 have different tones depending on the entered race horse.

When a horse race game is started, various event signals are supplied from the game control CPU 32 to the sound source controller 100. The sound source controller 100 equally generates background music, shouts, various announcements, etc., in response to the various event signals in the sound sources 1-12, and the twelve speakers SP1-SP12 make sounds.

When the horse race is started, the game control CPU 32 supplies the current positions of the race horses and race horse numbers to the sound source controller 100 in real time. The sound source controller 100 decides on the sound volume of the respective channels of each speaker SP1-SP12, based on the current positions of the race horses.

For example, it is assumed that six race horses No. 1 to No. 6 are entered and are running in the order of No. 1, No. 2, No. 3, No. 6, No. 5 and No. 4 as shown in FIG. 3, and as a result of the sound volume of the respective channels are decided as shown in FIG. 4.

A horse race game device performs a race in accordance with preset race developments, and it is possible to make hoofbeats based on the race developments. However, the present embodiment detects the current positions of the model race horses and makes hoofbeats, based on the current positions, whereby even if one model race horse is behind or stops due to an accident, hoofbeats corresponding to the actual situation can be made.

As shown in FIG. 4, hoofbeats of the model race horse No. 6 which has passed by, and those of the model race horse No. 5 which is coming near are outputted. The speaker SP2 outputs hoofbeats of the model race horses No. 2 and No. 3, and those of the model race horse No. 6 which is passing by. The speaker SP 3 outputs hoofbeats of the model race horse No. 1 which has passed by, those of the model race horses No. 2 and No. 3 which are passing by, and those of the model race horse No. 6 which is just coming up. The speaker SP 4 outputs hoofbeats of the model race horse No. 1 which is passing by, and hoofbeats of the model race horses No. 2 and No. 3 which are coming up. The speaker SP 5 outputs hoofbeats of the model race horse No. 1 which is coming near. The speakers SP 6, SP 7 do not output hoofbeats. The speaker SP 9 outputs hoofbeats of the model race horse No. 4 which is passing by, and those of the model race horse No. 5 which has passed by. The speaker SP 10 outputs hoofbeats of the model race horse No. 5 which is passing by, and those of the model race horse No. 4 which is coming up. The speaker SP 11 outputs hoofbeats of the model race horse No. 5 which is coming near, and those of the remote model race horse No. 4 which is coming near. The speaker SP 12 outputs hoofbeats of the model race horse No. 6 which has passed by, and hoofbeats of the remote model race horse No. 5 which is coming near.

FIG. 4 shows sound volume levels of the respective channels of the respective speakers, but note that the general sound volume is increased so that the empty channels can output hoofbeats to some extent.

As described above, the hoofbeat generation unit of the present embodiment can correctly reproduce the hoofbeats corresponding to the number of the entered model race horses and to the race developments, which can drastically improve the realistic feeling of sounds and images, aural perspective, etc. As a result, realistic effective sounds can be reproduced.

(Position Detecting Unit)

Figure 5:
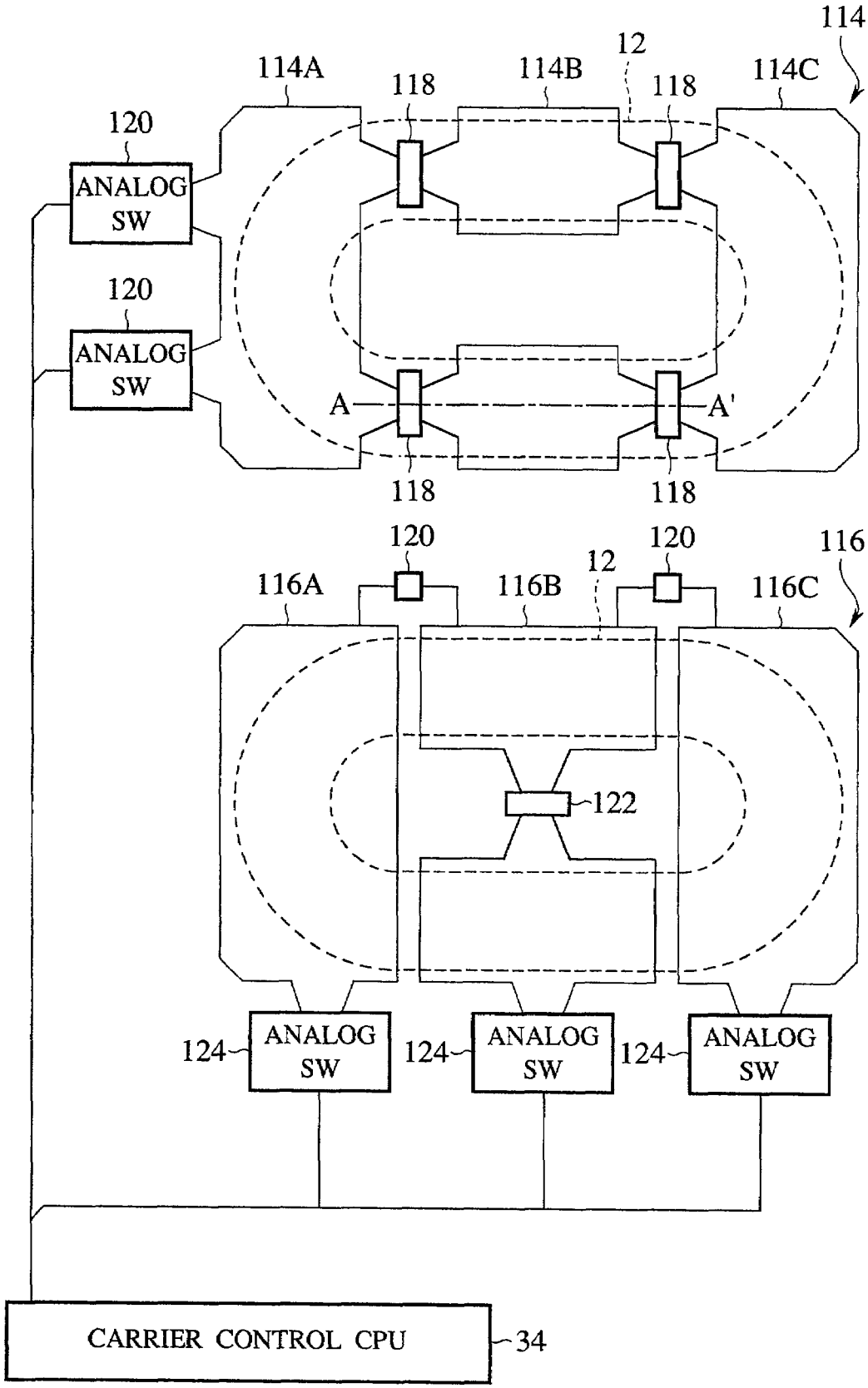
FIG. 5 is a view of a constitution of the position detecting unit of the horse race game device.
Figure 6:
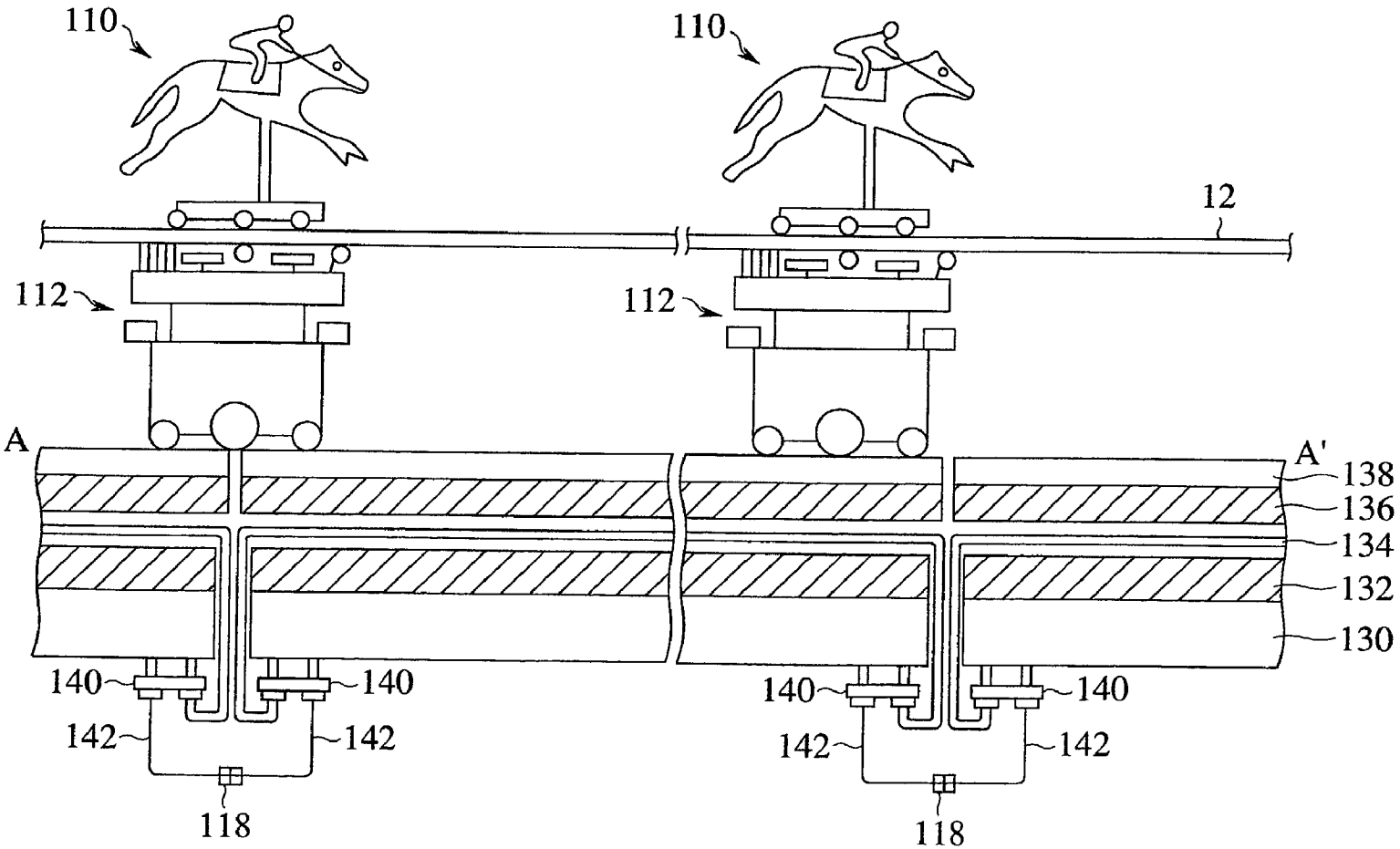
FIG. 6 is a sectional view of the position detecting unit of the horse-race game device, which explains the position detecting unit.

The constitution of the position detecting unit 40 is shown in FIGS. 5 and 6.

The position detecting unit of the present embodiment allows a large track on which a number of model race horses can be raced at once to be realized.

In the horse race game according to the present embodiment, as shown in FIG. 6, model race horses 110 on the track 2 are moved by carriers 112 below the track 12. As shown in FIG. 5, to detect positions of the carriers 112, an X-directional position detecting plate 114 which detects X-directional positions of the carriers 112, and a Y-directional position detecting plate which detects Y-directional positions of the carriers 112 are provided. The X-directional position detecting plate 114 and the Y-directional detecting plate 116 detect an oscillation signal outputted by an oscillation coil of the carriers 112 to thereby correctly detect positions of the carriers 112, i.e., the model race horses 110.

The track 12 is so large that it is difficult to form the position detecting plates 114, 116 one sheet each. In the present embodiment, therefore, the position detecting plates 114, 116 are respectively divided into three parts to facilitates their transportation, loading and installation.

As shown in FIG. 5, the X-directional position detecting plate 114 is longitudinally divided into three position detecting plates 114A, 114B, 114C which are connected to each other by connectors 118. The position detecting plate 114A is connected to the carrier control CPU 34 through analog switches 124.

The Y-directional position detecting plate 116 as well is longitudinally divided in three position detecting plates 116A, 116B, 116C which are connected to each other by connectors 120. The position detecting plates 116A, 116B, 116C are connected to the carrier control CPU 34 through the analog switches 124.

The X-directional position detecting plate 114 is in the form of a detection coil horizontally extended and is separated at positions of parting lines. Accordingly it is necessary that a number of detection coils are connected to each other by the connectors without gaps at the longitudinal parting lines in the detection region. Furthermore, it is necessary that the connectors 118 are easily detached when the X-directional position detecting plate 114 is assembled and disassembled.

As shown in FIG. 6, the present embodiment successfully satisfies these necessities. The X-directional position detecting plate 114 includes a wooden plate 132, a detection coil 134, a wooden plate 136, and a glass epoxy plate 138 which are laid one on another on a base 130 in the stated order. Connection electrodes 140 are disposed on parts of the underside of the base 130 of the respective position detecting plates 114A, 114B, 114C, which (parts) are at the longitudinal parting lines. The connection electrodes 140 are connected to the ends of the separated detection coil 134 and to the connectors 118 through wire harnesses 142.

In assembling the X-directional position detecting plate 114, as shown in FIG. 6, the connectors 118 connected to the connection electrodes of the divided position detecting plates 114A, 114B, 114C are connected, and the detection coil 134 horizontally extended is assembled.

In disassembling the X-directional position detecting plate 114, the connectors 118 are only disconnected, and the position detecting plates 114A, 114B, 114C are readily separated.

The Y-directional position detecting plate 116 is in the form of a vertically extended detection coil which is not separated by parting lines. Accordingly the ends of the divided position detecting plates 116A, 116B, 116C are simply connected to the connectors 120.

In the present embodiment, the detection coils of the X-directional position detecting plate 114 and the Y-directional position detecting plate 116 have a large coil pitch of 5-10 mm so that the position detecting plates 114, 116 generally have a short detection time.

As described above, the position detecting unit of the present embodiment makes it possible that a large track which is difficult to make of one sheet of position detecting plate can be easily assembled and disassembled by dividing the position detecting plate, whereby a large track on which a number of model race horses can race at once can be realized.

(Infrared Output Unit)

Figure 7:
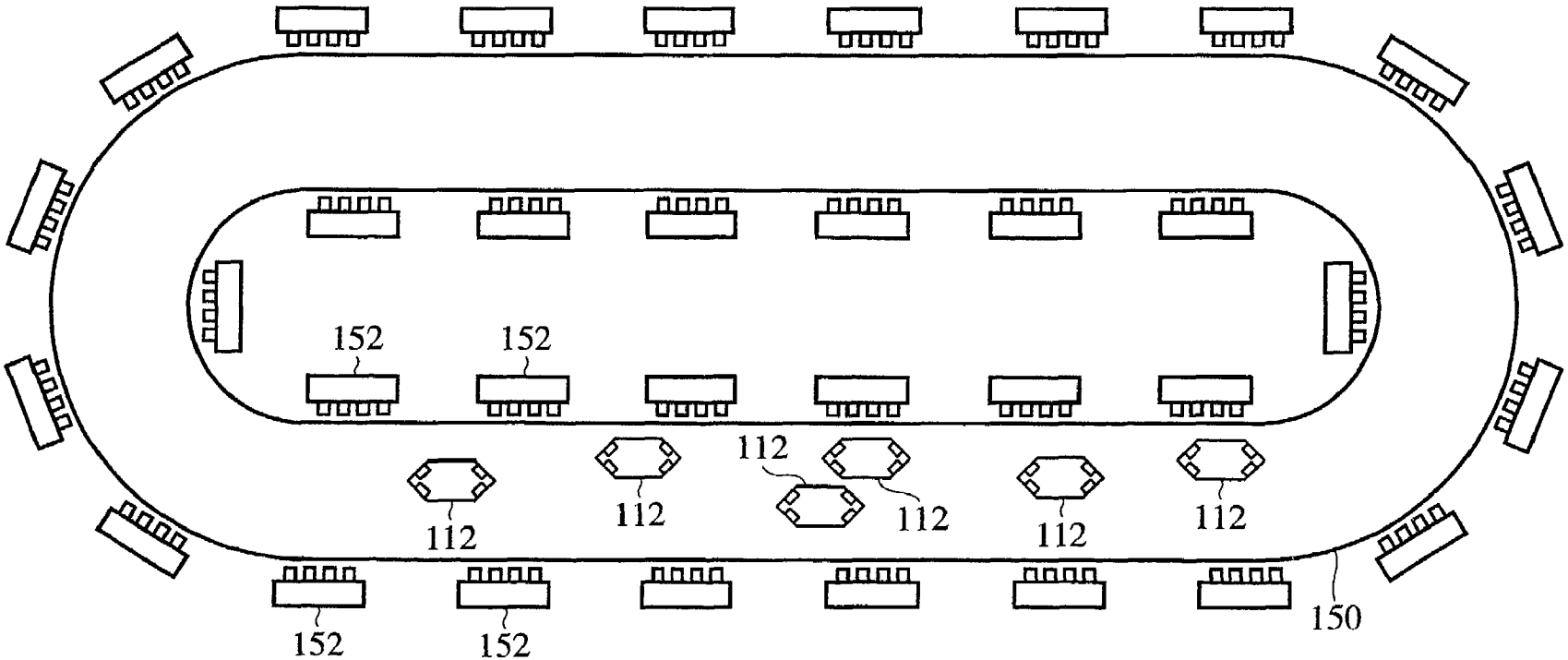
FIG. 7 is a view of a constitution of the infrared output unit of the horse race game device.
Figure 8:
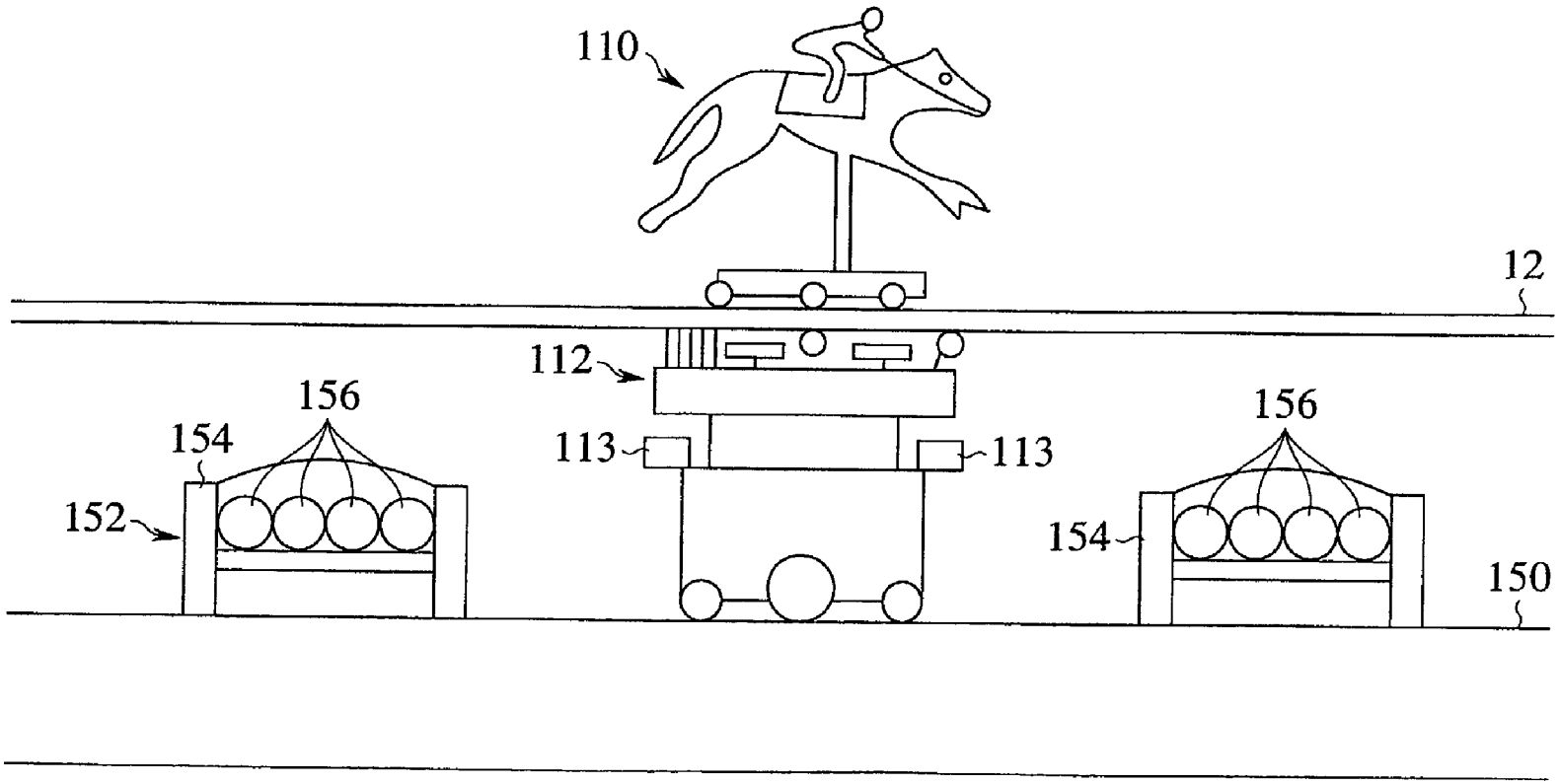
FIG. 8 is a sectional view of the infrared output unit of the horse race game device, which explains the infrared output unit.

A constitution of the infrared output unit is shown in FIGS. 7 and 8.

In the present embodiment, the infrared output unit 42 outputs infrared signals to output various command signals for the carriers 112. The carriers 112 run on a running track 150 corresponding to the track 12 for the model race horses 110 to run on. It is necessary that infrared command signals are transmitted to the carriers 112 on the running track 150 wherever the carriers 112 are located.

To this end, as shown in FIG. 7, a number of infrared emitting units 152 are disposed on the inner circumference of the running track 150, directed to the running track 150. On the outer circumference of the running track 150 a number of infrared emitting units are disposed, directed to the running track 150. The infrared emitting units 152 output infrared signals.

As shown in FIG. 8, each infrared emitting unit 152 includes a plurality of infrared emitting elements 156 disposed on a holding base 154. Infrared detecting elements 113 are disposed respectively on the front and the rear of each carrier 112 for detecting infrared signals outputted by the infrared units 152.

As described above, the infrared output unit of the present embodiment can transmit infrared command signals wherever the carriers are located on the running track.

(Light Emitting Turf)

A constitution of the light emitting turf will be explained with reference to FIGS. 9 and 10.

To make a horse race device interesting it is necessary to make a race impressive. To this end, during a race, images are displayed, background music is outputted, and the above-described hoofbeats are sounded. In the present embodiment light emitting bodies are buried in the track 12 on which the model race horses 110 run, and the light emitting bodies are actuated to make the race more impressive.

Figure 9:
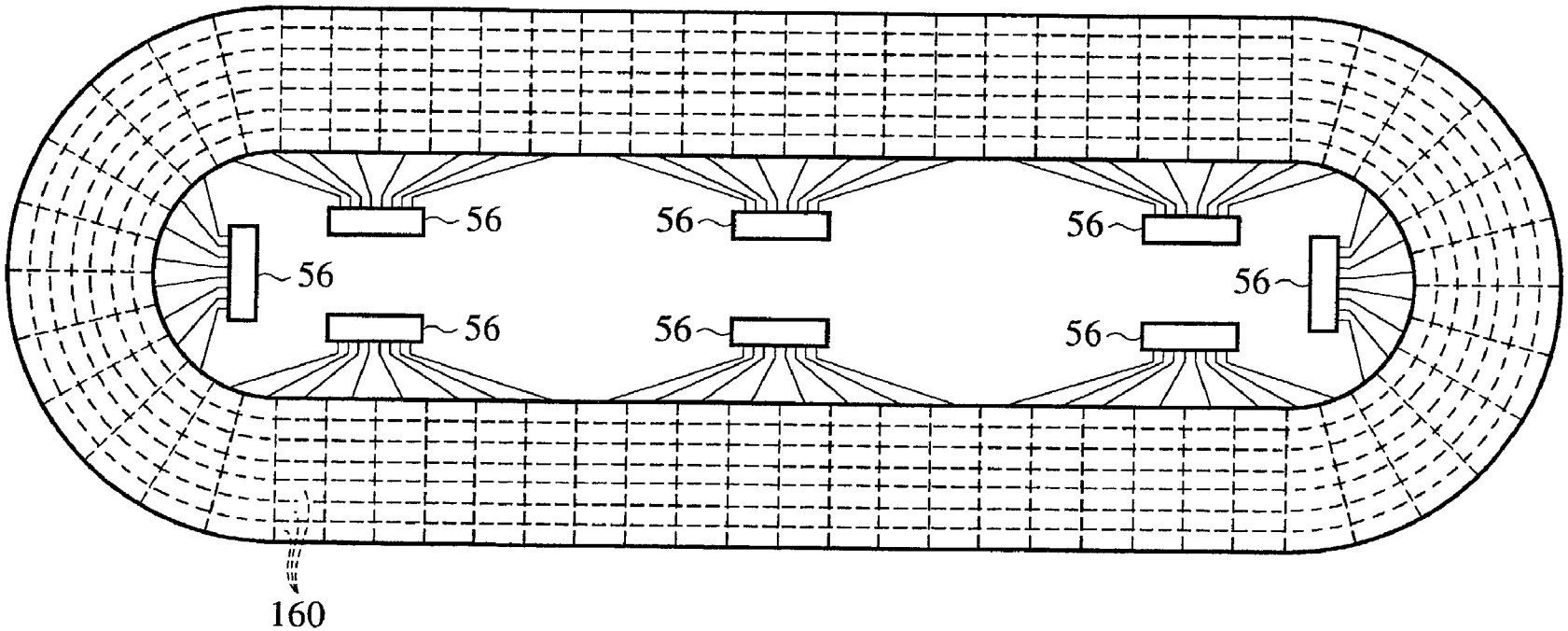
FIG. 9 is a view of a constitution of the light emitting turf of the horse race game device.

As shown in FIG. 9, the light emitting law 60 is in the form of a number of light emitting bodies 160 laid below the track 12. The light emitting bodies 160 each comprises a light emitting element, and for example, a number of EL devices or surface light emitting LED devices are laid under the turf 62. For control of the light emitting bodies 160 light emitting law control units 56 are provides for each of a required number of the laid light emitting bodies 160.

Figure 10:
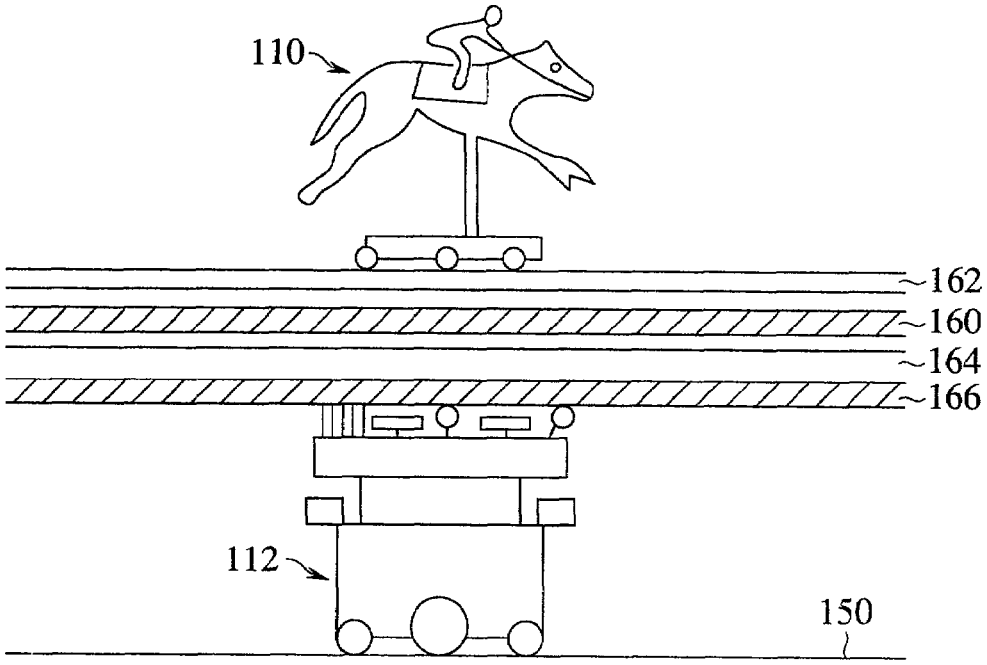
FIG. 10 is a sectional view of the light emitting turf of the horse race game device, which explains the light emitting turf.

As shown in FIG. 10, a turf 162 is disposed on the uppermost surface of the track 12. The light emitting bodies 160 are disposed on the underside of the turf 162. A carbon plate 164 and an electrode plate 166 are disposed on the underside of the light emitting bodies 160. The turf 162 is always green, and is formed of, e.g., a colored green material so that light from the light emitting bodies 160 is transmitted through the turf 162 when the light emitting bodies 160 emit the light. In the sectional view of FIG. 10 the track 12 is emphatically shown thick.

The light emitting turf control units 56 are connected to the main network CPU 30, and when the model race horses 110 run, the light emitting bodies 160 are caused to emit light in a pattern in which the light flows in a direction opposite to a running direction of the model race horses.

Until a race is started, the light emitting turf 60 is caused to emit light in a pattern which makes a bet time before the start of the race amusing. For example, the light emitting turf 60 is caused to emit light so that the track 12 has a pattern of stripes, and the stripes are caused to flow. The light emitting turf 60 is caused to emit light so that letters appear to be floating on the track 12 to notify players of the race's contents. When a trouble takes place, the light emitting turf 60 is caused to emit light to notify players of the trouble. The light emitting light turf is caused to emit light to display the countdown to a ballot time limit.

When a race is started, the light emitting turf 60 emits light based on positions of the model race horses 110 detected by the position detecting unit 40. For example, parts of the light emitting turf 60 near the model race horses 110 are caused to emit light in a pattern in which the parts flow in a direction opposite to a running direction of the model race horses, or the light emitting turf 60 is caused to emit light so as to extend or reduced in accordance with increases and decreases of speed to thereby make the model race horses appear speedy.

When the race is finished, the light emitting turf 60 is caused to emit light in a pattern designed for causing excitement and anticipation results of the race. For example, the track 12 has a stripe pattern, and the light emitting turf 60 is caused to emit light so as to make the stripes appear flowing, and the light emitting turf 60 is caused to emit light so as to make letters appear to float on the track 12 to notify the results of the race or to display decisive results of the race.

As described above, in addition to images, and sounds, such as background music, hoofbeats, etc., the track on which model race horses are running is caused to emit light to thereby make races more impressive.

(Satellites (Part 1))

A constitution of the satellites will be explained with reference to FIGS. 11 to 13.

Figure 11:
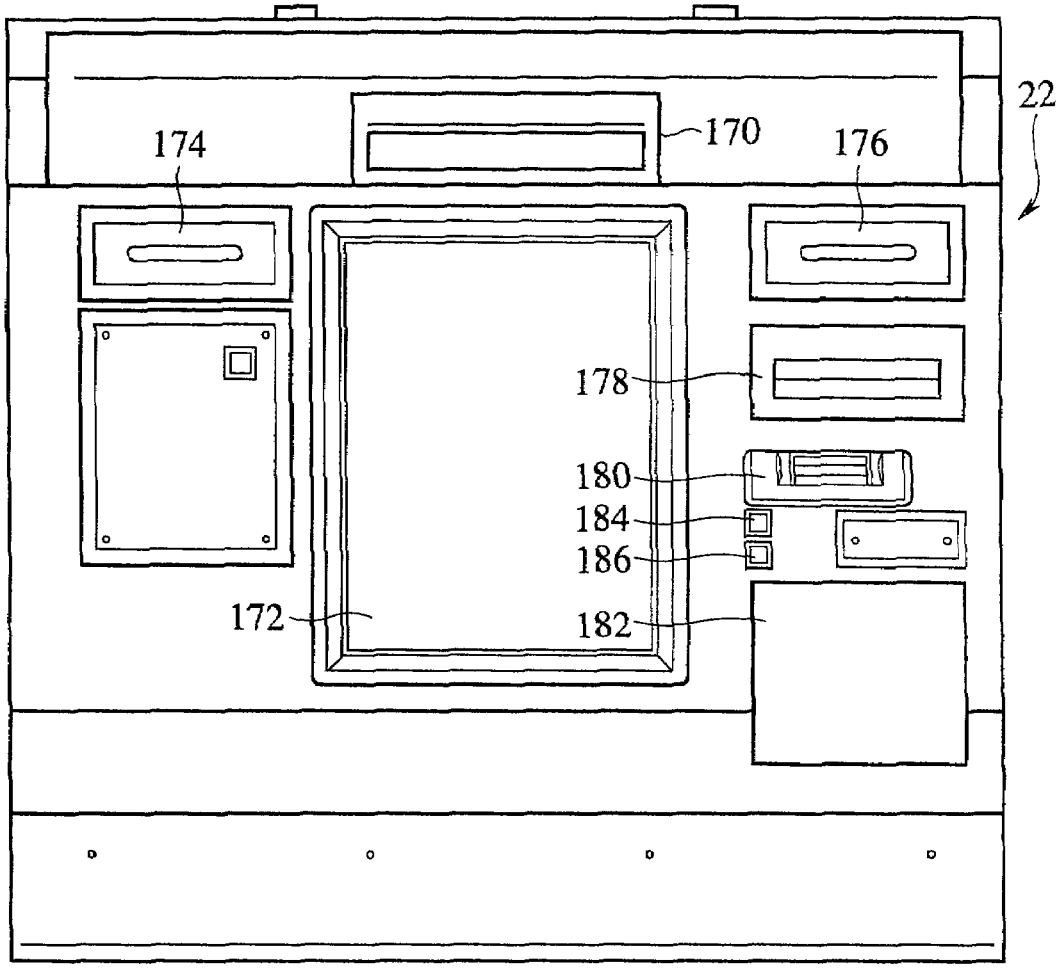
FIG. 11 is a top view of a satellite of the horse race game device.

FIG. 11 is a top view of the satellite 22. A dome speaker 170 which outputs hoofbeats is disposed at the center of an upper part of the satellite 22. As described above, the dome speaker 170 sounds hoofbeats to make a race more impressive.

A 17-inch monitor 172 is disposed below the dome speaker 170. A transparent touch panel is disposed on the surface of the 17-inch monitor 172. Satellite speakers 174, 176 are disposed on the left and the right sides of the 17-inch monitor 172.

A note slot 178 and medal slot 180 are formed below the satellite speaker 176 on the right side of the 17-inch monitor 172. An automatic coin charge/discharge openings 182 through which a large number of medals can be charged/discharged is formed below the medal slot 180. An automatic charge start button 184 and a payout button 186 are disposed between the medal slot 180 and the automatic charge/discharge opening 182.

In a case that cash may be used, the note slot 178 is actuated so that cash can be used for a bet. In a case that cash may not be used, the note slot 178 is not actuated, and a game is played only with medals.

In a case that a game is played by using medals, medals may be charged through the medal charge opening 180, or the automatic charge start button 184 may be pressed with medals accepted in the automatic charge/discharge opening 182, and the automatic charge start button 184 is pressed to accept a number of medals at once.

When an anticipated bet comes true, a right to an payout allotment is generated, and an allotted number of medals are accumulated in the horse race game device. The accumulated medals in the horse race game device can be used for betting.

When the game is completed, and the allotted medals are discharged, the pay out button 186 is pressed down, and the medals are discharged into the automatic charge/discharge opening 182. The player can receive the medals through the automatic charge/discharge opening 182.

Figure 12:
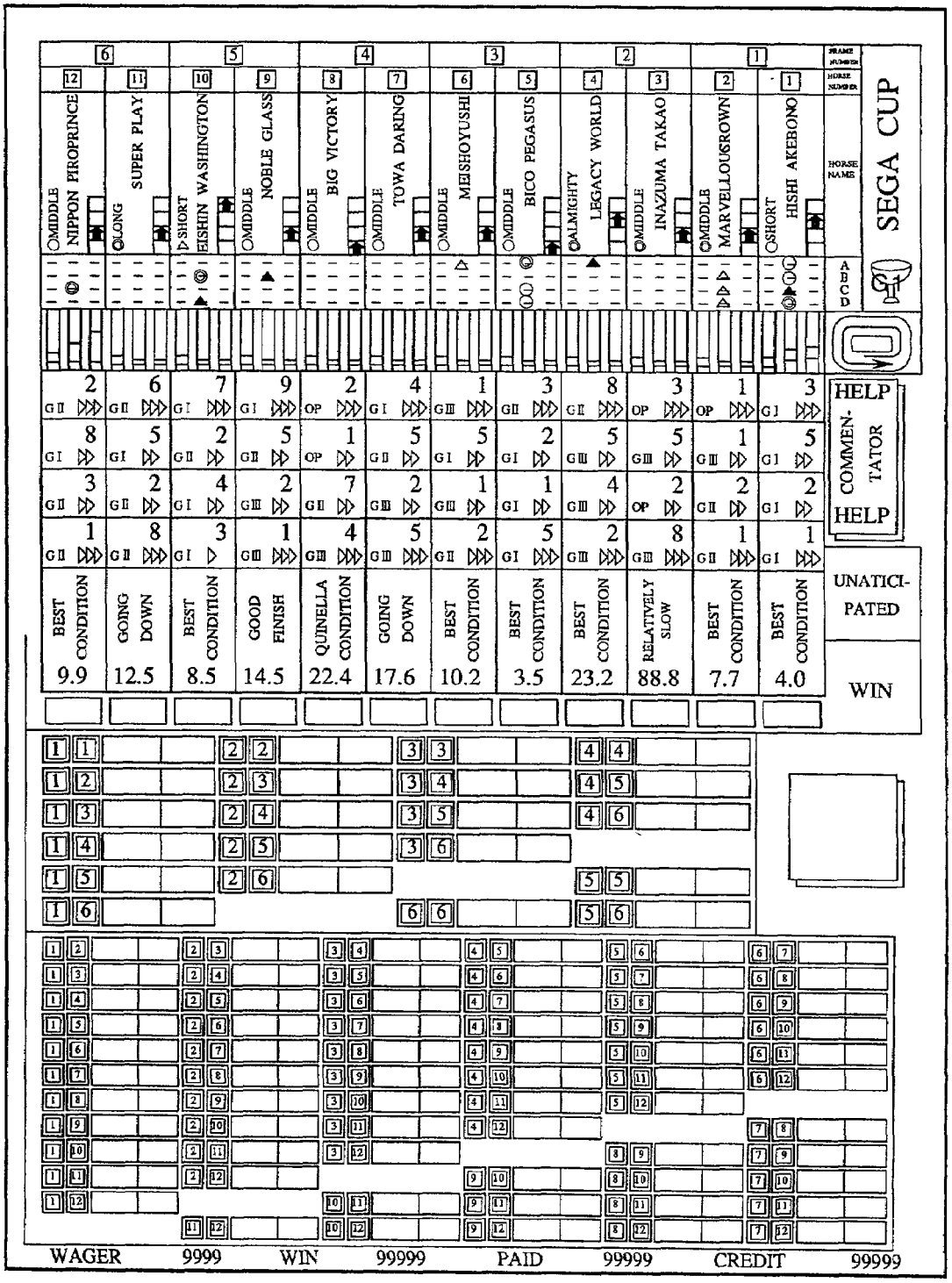
FIG. 12 is a view of one example of game displays shown by the satellite of the horse race game device.
Figure 13:
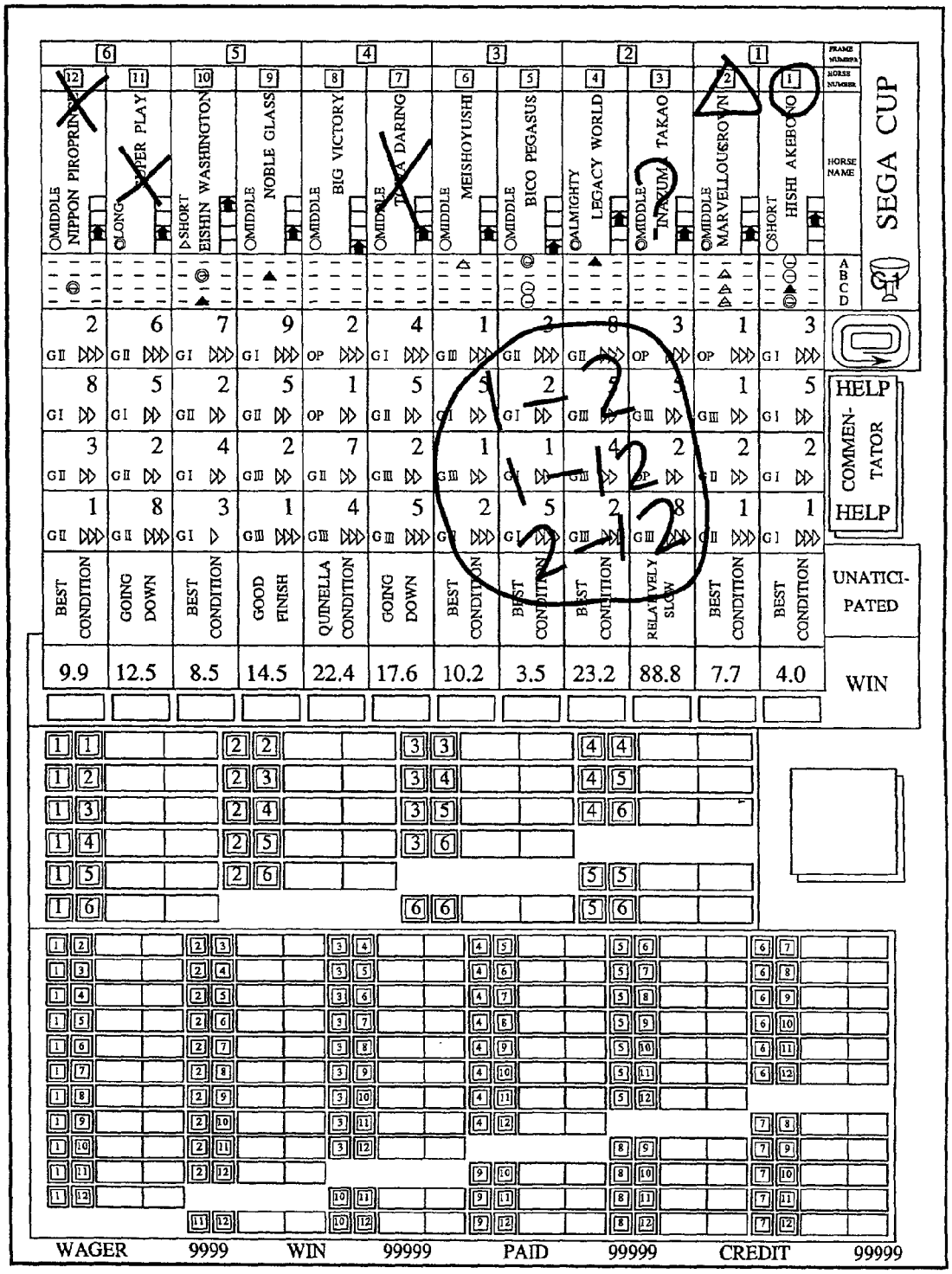
FIG. 13 is a view of another example of game displays shown by the satellite of the horse race game device.

FIG. 12 shows one example of bet displays on the 17-inch monitor 172. Race information is displayed on an upper part of the monitor screen, and bet command buttons are displayed on a lower part of the monitor screen. The player decides on a bet based on the race information on the upper part of the monitor screen. The player presses down bet command buttons, and confirmation sounds are outputted through the satellite speakers 174, 176.

In real-life horse races, bettors look at horse race newspapers or observe the condition of race horses in paddocks and fill out anticipated memos with red pencils on the horse race newspapers. In the present embodiment, the player traces with his finger the region of the race information on the upper part of the monitor screen, and positions of the trace are recognized by the touch panel, and the trace is depicted in a red line. For example, as shown in FIG. 13, entered horses are marked with O, X, Δ, ?, etc., and anticipated contents for betting 1-2, 1-12, 2-12, etc. are written down as memos on the monitor screen.

The memos can be written by the use of the touch panel only while race information is displayed and are erased simultaneously upon the change of the display image.

As described above, in the satellite of the present embodiment, arbitrary memos can be written down on the monitor screen, and as in an actual horse race, game players can enjoy realistic anticipation of betting on race horse by writing down memos.

(Satellites (Part 2))

Figure 14:
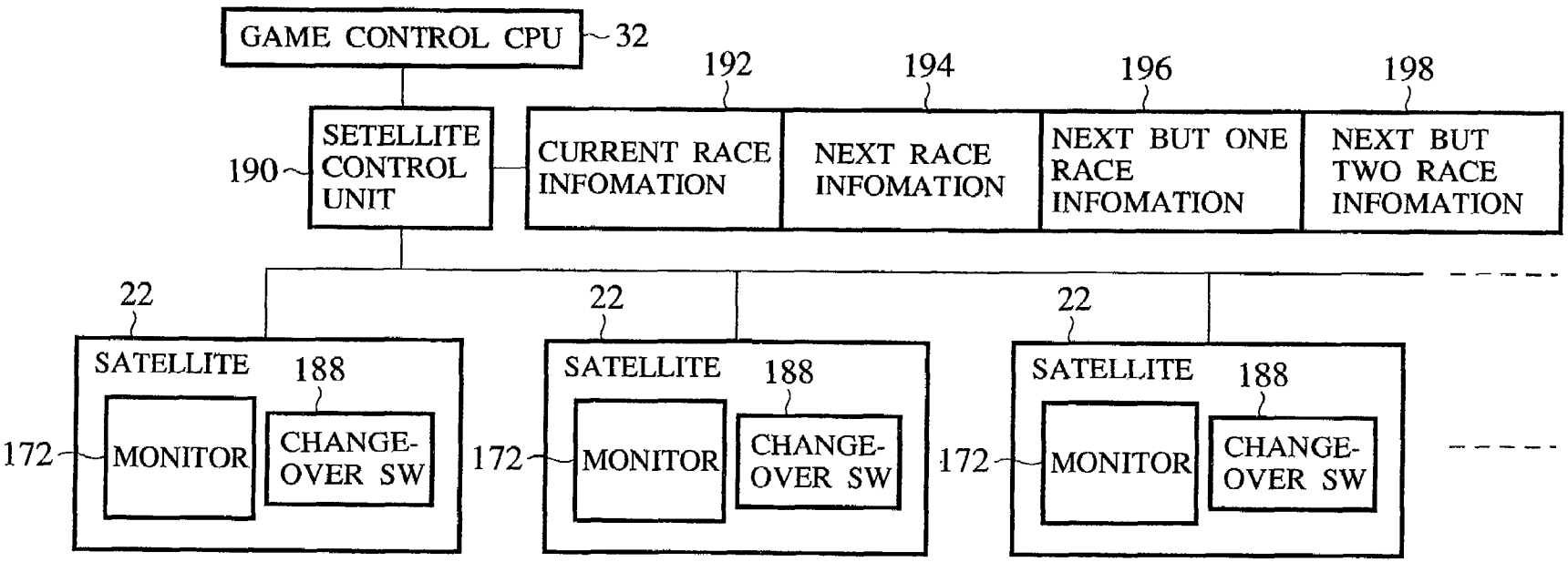
FIG. 14 is a block diagram of the satellite of the horse race game device, which shows a constitution of the satellite.

A constitution of the satellites 22 according to another embodiment will be explained with reference to FIG. 14.

In the above-described embodiment, information of a current race is displayed on the 17-inch monitor 172 of the satellite 22, and bets are made on the race. No bet can be made during the race until the next race. Accordingly the time in which players can place a bet is the short period of time from an advance announcement of a race to the start of the race, which cannot afford players sufficient time to anticipate and discuss a race with their friends.

In consideration of this, the present embodiment includes a satellite control unit 190 which selectively displays in the satellites 22 images corresponding to current race information and information of races to be held later. The satellite control unit 190 includes, e.g., four race information memories 192-198. The race information memory 192 stores current race information, and the race information memory 194 stores next race information. The race information memory 196 stores the next but one race information. The race information memory 198 stores the next but two race information.

Each satellite 22 includes a 17-inch monitor 172 which displays race information, and switch 188 which switches race information. A player operates the switch 188 of the satellite 22 to display images of race information selected from a plurality of race information stored in the race information memories 192 p 198 on the 17-inch monitor 172. The player bets on the race displayed on the 17-inch monitor 172.

Accordingly, when a player wishes to take more time to anticipate a race, he reads next but two race information stored in the race information memory 196 by displaying the same on the 17-inch monitor 172, and, based on the race information, anticipates and bets on the race for betting. When he wishes to take some time to anticipate a race, he reads next but one race information stored in the race information memory 194 by displaying the same on the 17-inch monitor 172, and, based on the race information, anticipates and bet on the race. When he wishes to bet on a current race to get an allotment, he reads the current race information by displaying the same on the 17-inch monitor 172, and, based on the same, he anticipates and bets on the race.

As described above, the satellite according to the present embodiment permits a player to display race information as he wants and to bet on the race. This allows him to take sufficient time to anticipate the race or to discuss the race with his friends. Nevertheless more time is not necessary between races and operation efficiency of the horse race game device is not reduced.

(Start Gate)

A constitution of the start gate will be explained with reference to FIGS. 15 and 16.

The start gate of the present embodiment opens at the start of a race, as does a start gate for actual horse races.

Figure 15:
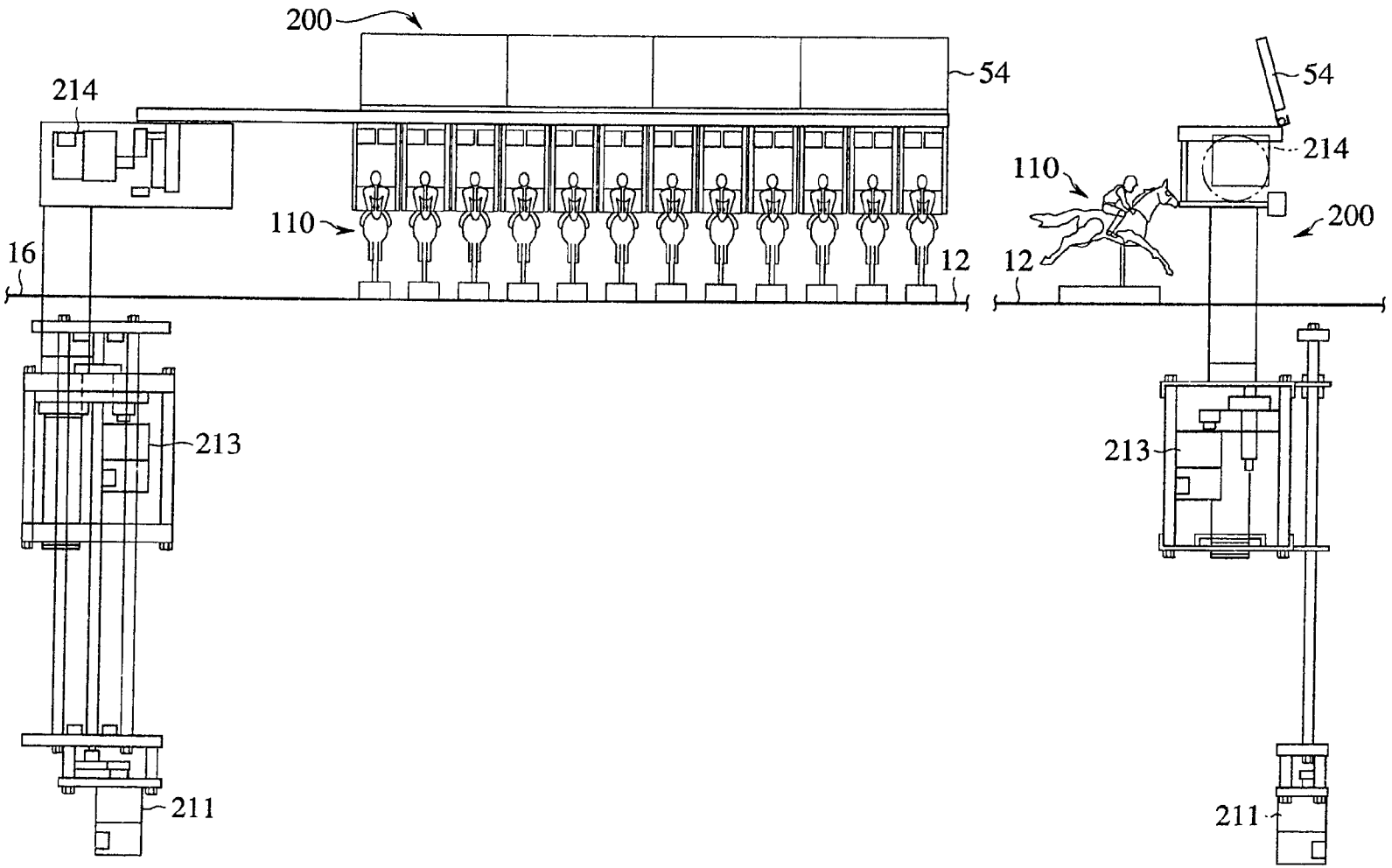
FIG. 15 is a view of a constitution of the start gate of the horse race game device.

As shown in FIG. 15, the start gate 200 includes twelve gates 202 for twelve model race horses to start from. On the tops of the gates 202 there is disposed a gate dot matrix 54 which displays entry horse numbers, horse names, etc. The gate dot matrix 54 includes 4 sheets of 16×32 dot matrix LEDs arranged horizontally.

Figure 16:
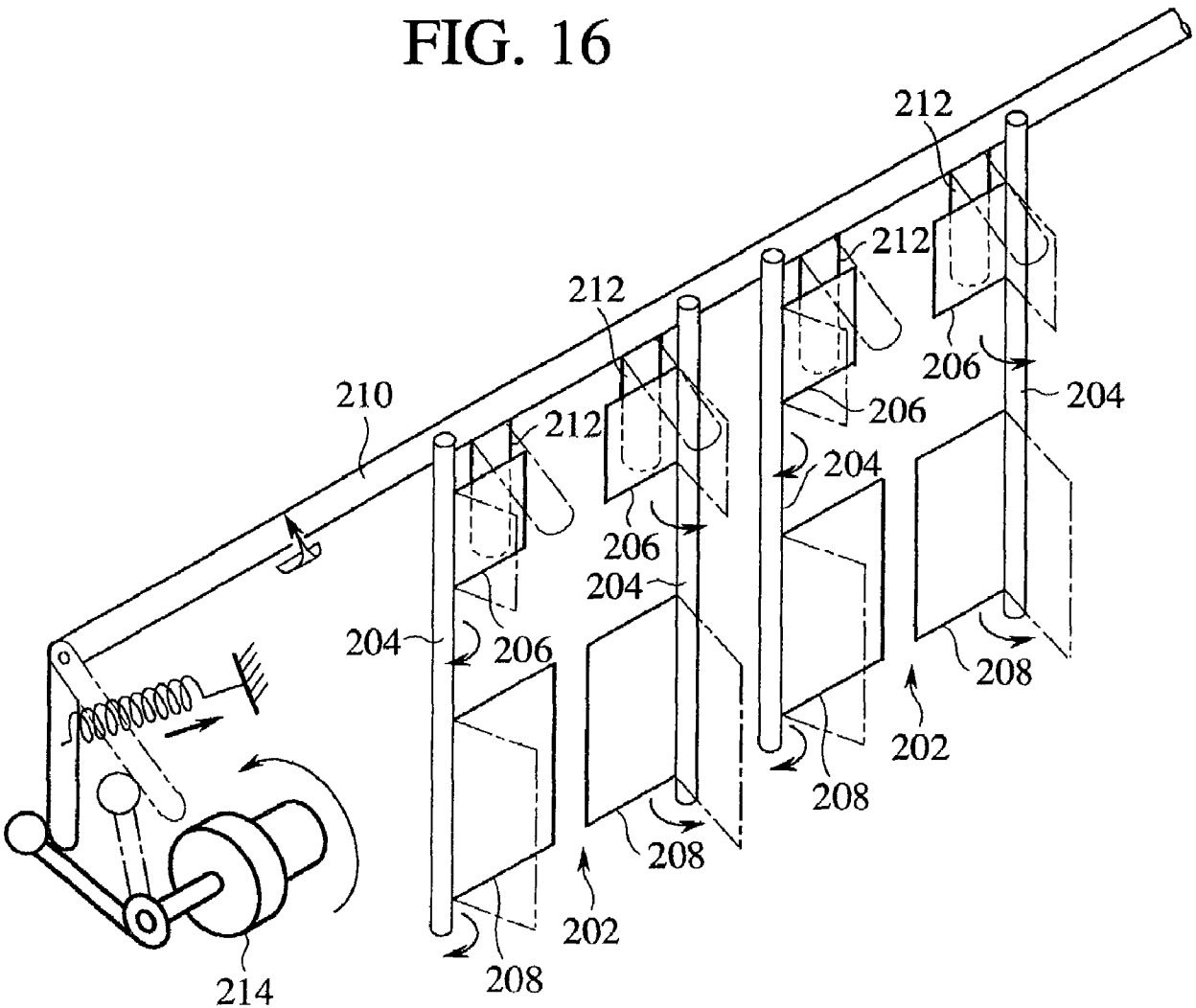
FIG. 16 is a perspective view of the start gate of the horse race game device, which explains its operation.

As shown in FIG. 16, each gate 202 includes a gate frame 204. The gate frame 202 includes an upper gate door 206 and a lower gate door 208. A rotary shaft 210 for opening the gates is disposed near the tops of the gate frames 204. Gate opening rods 212 for pushing the gate doors 206 are projected from the rotary shaft 210.

When the rotary shaft 210 is rotated to the foreground in FIG. 16, the gate opening rods 212 push the upper gate doors 206. Then the upper and the lower gate doors 206, 208 are rotated on the gate frame 204, and the gates 202 are opened.

A shown in FIG. 15, a gate mechanism 72 includes a vertical operation motor 211 which vertically moves the entire start gate 200, and a swing motion motor 213 which rotates the entire start gate 200, and a gate opening/closing motor 214 which opens and closes the gates 202.

The start gate 200 is originally located in a paddock 20 in the track 12. When a race is started, the entire start gate 200 is lifted by the vertical motion motor 211, and then the entire start gate 200 is rotated to a set position by the swing motion motor 213, and next, the entire start gate 200 is lowered to the track 12 by the vertical motion motor 211.

Entered model race horses 110 are directed to the start gate 200, enter their associated gates 202 and then stop. At this time, it is possible to imagine that model race horses 110 are caused to go back in front of the associated gates 202 so that they appear to reject entering the gates, as horses sometimes do in real-life.

When twelve race horses enter the gates 202, the rotary shaft 210 is rotated to the foreground by the gate opening/closing motor 214 to rotate the gate doors 206, 208 on the gate frame 204 by the gate opening rods 212, and the gates 202 are opened. When the gates 202 are opened, the model race horses 110 start running at once to start a race.

When the race is started, the rotary shaft 210 is returned to its original position, and after the gates 202 are closed, the start gate 200 is returned to its original position in the paddock by the vertical motion motor 211 and the swing motion motor 213.

As described above, the start gate of the present embodiment opens the gate at the start of a race, as in actual horse race, which makes the horse race realistic.

(Truck and Carrier of Model Race Horse)

Figure 17:
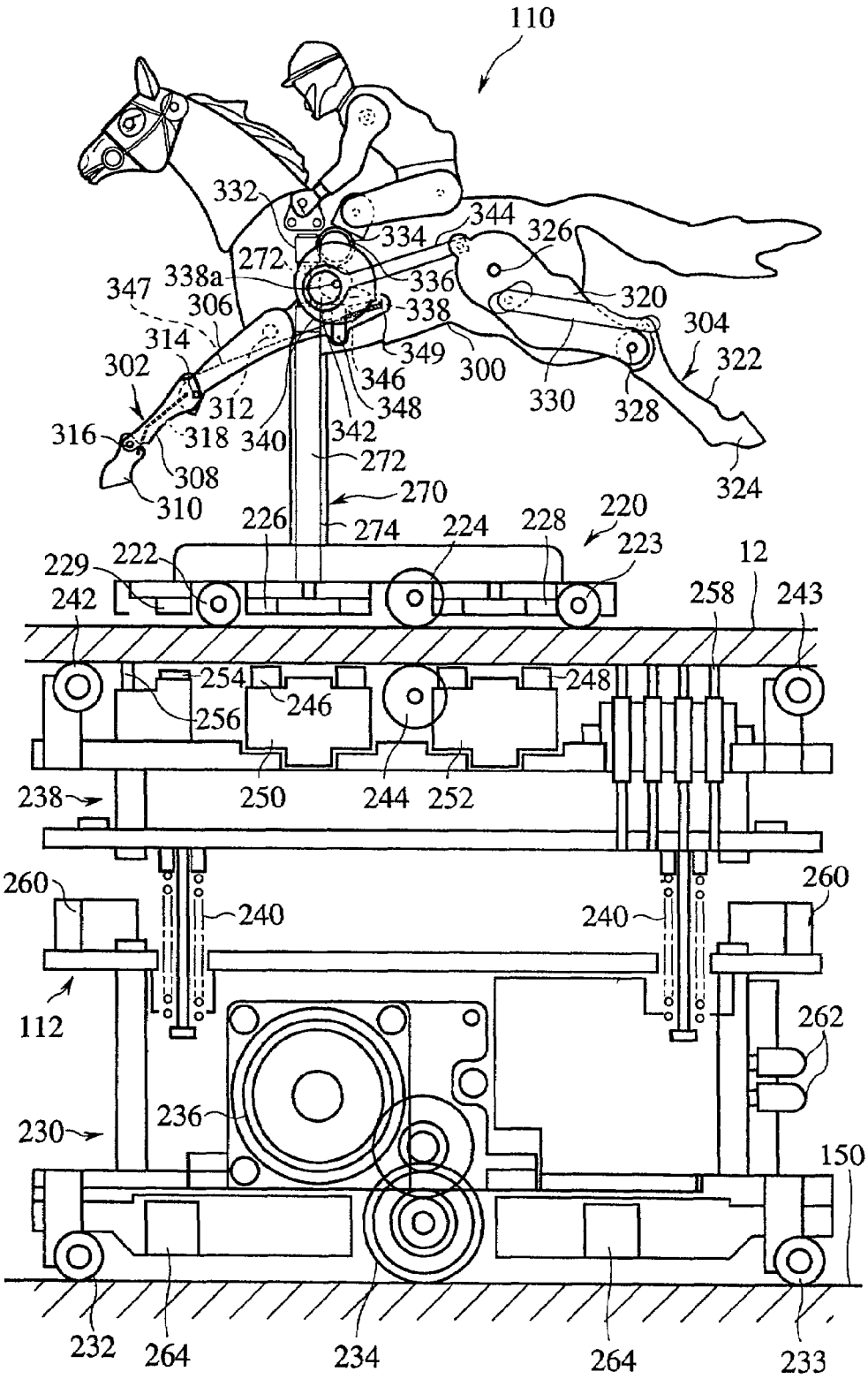
FIG. 17 is a sectional view of the truck and the carrier of the model race horse of the horse race game device, which shows structures thereof.
Figure 18A:
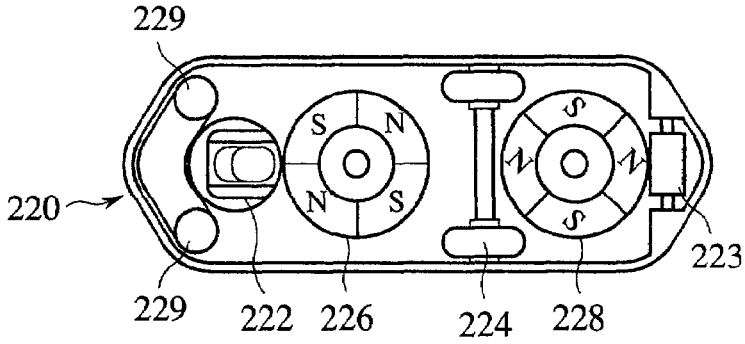
FIG. 18 is views of a constitution of the truck and the carrier of the race horse of the horse race game device, FIG. 18A being a bottom view of the truck of the race horse, FIG. 18B being a plan view of the carrier, and FIG. 18C being a sectional view of the carrier near the center thereof.
Figure 18B:
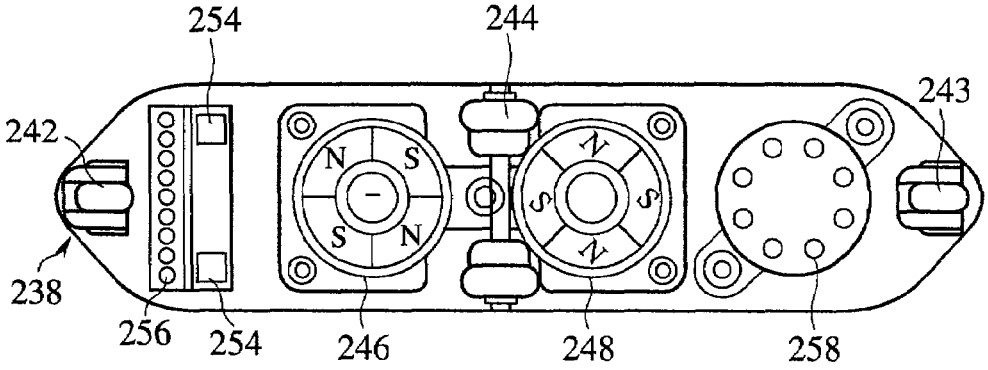
Figure 18C:
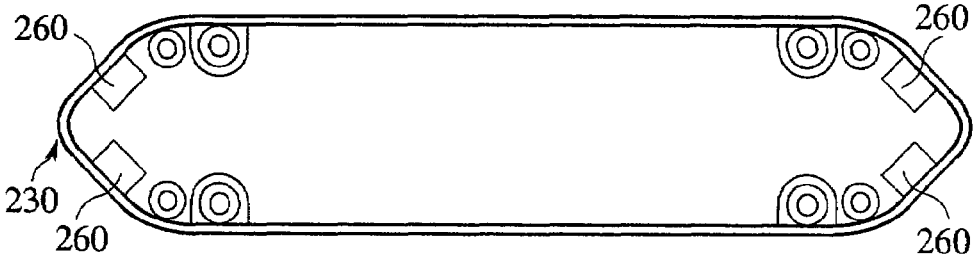
Figure 19:
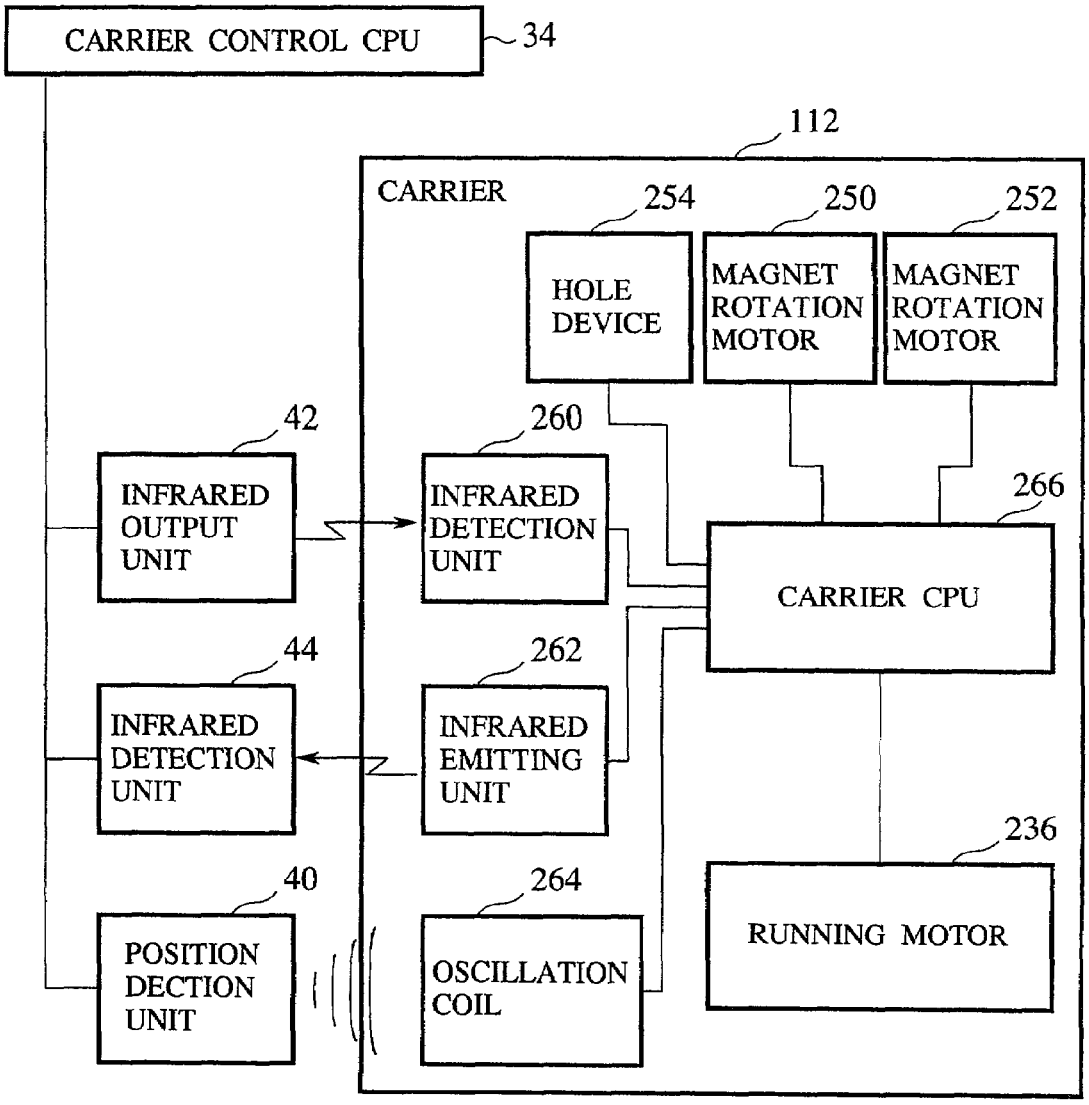
FIG. 19 is a block diagram of the carrier of the horse race game device.

A truck and a carrier of a model race horse will be explained with reference to FIGS. 17 to 19. FIG. 17 is a structural view of the truck and the carrier of a model race horse. FIG. 18A is a bottom view of the truck of a model race horse, FIG. 18B is a plan view of the carrier, FIG. 18C is a sectional view of the carrier near the center of the carrier, and FIG. 19 is a block diagram of the carrier.

A model race horse 110 mounting a model jockey runs on the track 12, but as shown in FIG. 17, the model race horse 110 is supported on the truck 220. The truck 220 is mounted on the track 12, capably of running, by a front and a rear wheels 222, 223 which can smoothly change a running direction and a pair of wheels 224 journalled on both sides of the track 12.

The truck 220 includes two rotary magnets 226, 228 which are arranged in the front-to-rear direction, a little spaced from the upper surface of the track 12. As shown in FIG. 18A, the rotary magnets 226, 228 have a ring shape, include four magnet pieces arranged on the circumference with their polarities alternately being opposite, and are rotatably pivoted on the truck 220. A magnet 229 for judging the direction of the truck 220 is disposed on a forward part of the truck 220.

As shown in FIG. 17, the running track 150 is disposed below the track 12 with a space therebetween. Carriers 112 which pull the trucks 220 of the model race horses 110 on the track 12 are disposed on the running track 150 capably of running. One carrier 112 is disposed for each of the twelve model race horses 110.

A carrier body 230 is mounted on the running track 150, capably of running, by a front and a rear wheels 232, 233 and a pair of wheels 234 journalled on both sides of the carrier body 230. The wheels 234 of one pair on both sides are connected respectively running motors 236 for one pair. When the pair of running motors 238 are rotated at the same speed, the carrier body 230 is driven forward, and when the running motors 238 are rotated at different speeds, the carrier body 230 is turned left or right so as to change the running direction.

It is possible that a common running motor 236 is provided for the wheels 234, and steering motors for changing the running direction are provided for the front and the rear wheel 232, 233.

Above the carrier body 230 there is provided a support base 238 urged upward by springs 240. Front and rear wheels 242, 243 are disposed on the upper surface of the support base 238, and a pair of wheels 244 are journalled on both sides of the support base 238, whereby the support base 238 is capable of running on the backside of the track 12. Thus the carriers 112 can freely run, kept upright between the track 12 and the running track 150 and in a space between both tracks 12, 150 by the wheels 232, 233, 234 disposed on the backside thereof and the wheels 242, 243, 244 disposed on the upper surface thereof.

As shown in FIG. 18B, rotary magnets 246, 248 are disposed, a little spaced from the back side of the track 12 at respectively corresponding positions to the rotary magnets 226, 228 of the truck 220 on the track 12. The rotary magnets 246, 248 have the same constitution as the rotary magnets 226, 228 of the truck 220.

The rotary magnets 226, 228 are rotated by magnet rotating motors 250, 252. The magnet rotating motors 250, 252 each include rotors (not shown) formed in one piece with the rotary magnets 226. 228, and motor coils (not shown) formed horizontally on a flexible base plate.

As shown in FIG. 18B, hall devices 254 are provided at positions corresponding to the magnets 229 of the truck 220 on the track 12. The magnets 229 on the truck 220 are detected by the hall devices 254 to thereby judge whether or not the truck 220 and the carriers 112 are correctly oriented.

A brush 256 is disposed on a forward part of the base 238 of the carrier 112, and a collector 258 is disposed on a rear part of the base 238. The brush 256 cleans a feeder (not shown) on the underside of the track 12, and the collector 258 supplies electric power to the carrier 12 through the feeder.

As shown in FIGS. 17 and 18C, infrared detectors 260 are disposed on the front and the rear of the carrier body 120 of the carriers 112, and the carriers 112 are controlled in response to infrared signals detected by the infrared detectors 260.

As shown in FIG. 17, infrared emitters 262 are disposed on the rear of the carrier body 230 of the carriers 112 and output diagnostic results of the carriers 112 as infrared signals.

As shown in FIG. 17, oscillation coils 264 are disposed on the carrier body 230 of the carriers 112, a little spaced from the upper surface of the running track 150. Positions of the carriers 112 are detected based on oscillation signals from the oscillation coils 264.

FIG. 19 is a block diagram of a control system for controlling the carriers 112.

Each carrier 112 includes a carrier CPU 266. The carrier CPU 226 is connected to the above-described running motor 236, the magnet rotating motors 250, 252, the hall devices 254, the infrared detectors 260, the infrared emitter 262 and the oscillation coils 264.

The carrier CPU 266 controls the oscillation coils 264 so that the oscillation coils 264 output oscillation signals at a prescribed interval. The position detecting unit 40 detects positions of the carriers, based on the oscillation signals.

The infrared detectors 260 detect infrared signals outputted by the infrared output unit 42 to transmit control signals to the carrier 112. The carrier CPU 266 controls the drive of the running motor 236, and the magnet rotating motors 250, 252, based on the infrared signals.

The carrier CPU 266 controls the running motor 236 to run along a preset course while detecting a current position of the carrier 112 by the position detecting unit 40, based on oscillation signals from the oscillation coil 264. The carrier CPU 266 always detects based on output signals from the hall devices 254 whether or not the truck 220 of the model race horse has been positionally deflected from the carrier 112.

The carrier CPU 266 controls the rotation of the magnet rotating motors 250, 252, based on infrared signals form the infrared output unit 42 independently of each other and independently of the drive of the running motor 236.

When the rotary magnets 246, 248 of the carrier 112 are rotated by the magnet rotating motors 250, 252, the rotary magnets 226, 228 of the truck 220 of the model race horse 110 on the truck 12 are rotated respectively in synchronization with each other.

The model race horse 110 is supported by a support member 270 extended from the truck 220. A first drive shaft 272 is disposed at the center of the support member 270, and a second drive shaft 274 surrounds the first drive shaft 172. The first and the second drive shafts 272, 274 are rotatable independently of each other.

When the magnet 226 on the forward part of the truck 220 is rotated, the first drive shaft 272 is rotated, and when the rotary magnet 228 on the rear part of the truck 220 is rotated, the second drive shaft 274 is rotated. When the first drive shaft 272 is rotated, the forelegs and the hindlegs of the model horse swing, and the arms and legs of the model jockey on the mode race horse 110 swing when the second drive shaft 272 is rotated.

When the rotary magnets 246, 248 of the carrier 112 are rotated, the rotary magnets 226, 228 of the truck 220 are rotated respectively in synchronization with each other. Accordingly the rotary magnet 246 of the carrier 112 is rotated to thereby control swing of the forelegs and hindlegs of the model race horse, and the motions of the arms and legs of the model jockey on the model race horse 110 can be controlled by controlling the rotation of the rotary magnet 248 of the carrier 112.

Whether, or not the rotary magnets 246, 248 of the carrier 112 are rotated, the truck 220 is pulled by attractive forces between the rotary magnets 226, 246 and between the rotary magnets 228, 248 to thereby run on the same course as the carrier 112. When the truck 220 is deflected from the carrier 112, the carrier CPU 266 of the carrier 112 detects the deflection, based on outputs from the hall devices 254.

In the present embodiment, the carrier CPU 266 is mounted on the carrier 112. This enables the following processing which has been conventionally impossible.

First, by mounting the carrier CPU 266 on each carrier 112, each carrier 112 can judge its states by itself. For example, the carrier 112, which includes the running motor 236 and the magnet rotating motors 250, 252 mounted on, can judge operational states of the motors by itself with its own carrier CPU 266. Results of the self-diagnoses are outputted as infrared signals from the infrared emitting unit 262.

In the present embodiment, the infrared detecting unit 44 is disposed near the start point, and when the carriers 112 are gathered at the start point, the infrared output unit 42 outputs to the carriers 112 a command signal which command the carriers 112 to output results of the diagnoses. The carrier CPU 266 makes the diagnoses and output the results of the diagnoses from the infrared emitting unit 262 as infrared signals. The infrared detecting unit 44 detects the infrared signals outputted by the carrier and obtains the results of the diagnoses.

The carrier CPU 266 mounted on each carrier 112 can control the pulse width modulation (PWM) of the motors. The carrier CPU 266 controls the PWM of the running motor 236, and the magnet rotating motors 250, 252. The PWM control can control the rotation numbers of the motors, which permits subtle motions of the carrier 112 and subtle motions of the model race horse 110. In addition, the motor can have smaller electric power consumption and reduced heat output.

The carrier CPU 266, which is mounted on each carrier 112, makes it easy to control the rotation directions of the motors. The carrier CPU 266 reverses the rotation direction of the running motor 236 to thereby make the carrier 112, i.e., the model race horse 110, reverse its direction. The model race horse 110 is reversed so that the horse 110 appears to be hesitating upon entering the gate or appears to fail to make a uniform start, or is reversed for maintenance.

(Model Race Horse and Model Jockey)

Constitutions of a model race horse and a model jockey will be detailed with reference to FIGS. 20 to 25.

The model race horse 110 has a body 300 supported on the truck 220 by the support member 270. As shown in FIG. 17, the support member 270 includes a first drive shaft 272 and a second drive shaft 274. The second drive shaft 274 is rotated in the same direction as the rotary magnet 228 by a transmission mechanism disposed in the truck 220 when the rotary magnet 228 is rotated.

A constitution of the model race horse 110 will be explained with reference to FIGS. 20 and 21.

Figure 20:
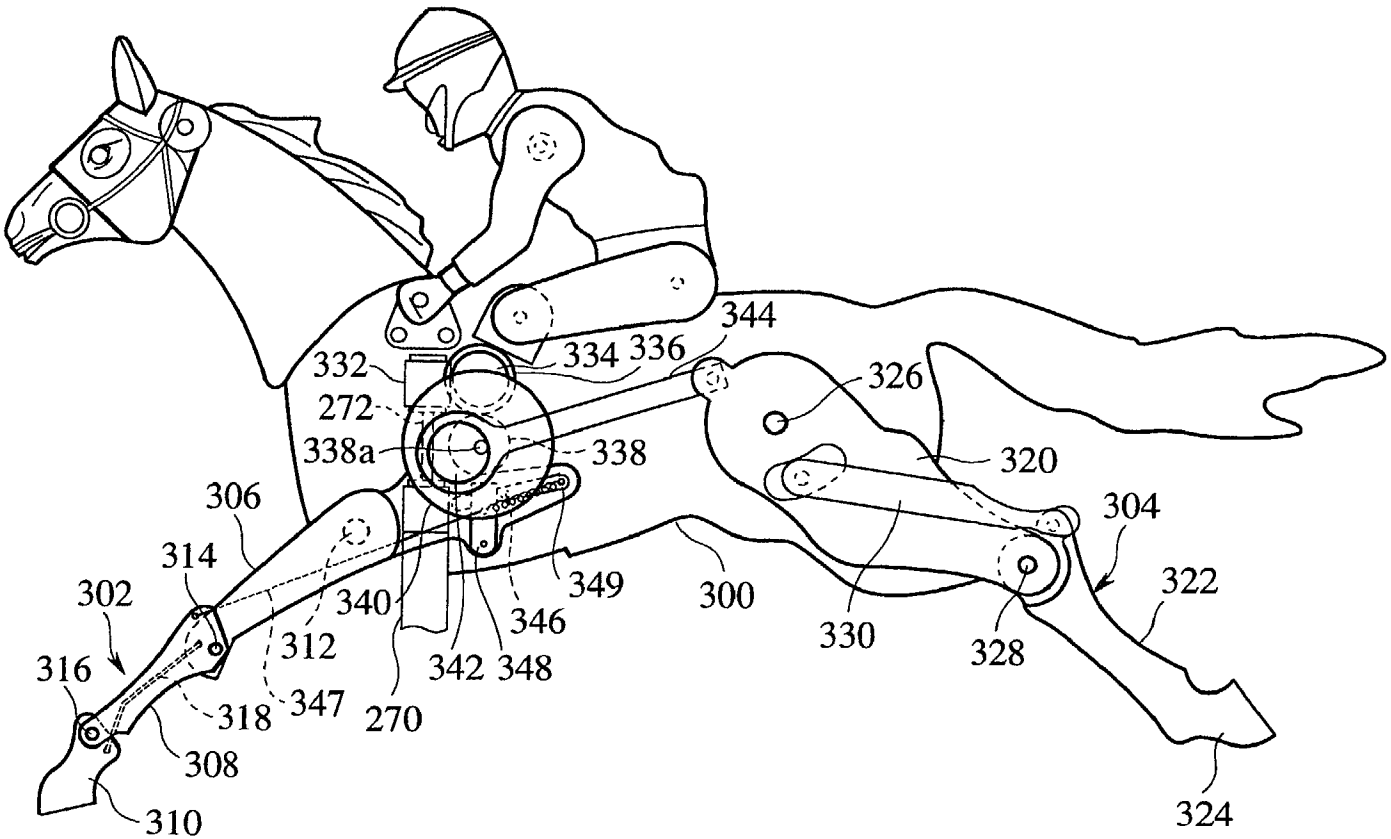
FIG. 20 is a view of a constitution of the race horse of the horse race game device.

As shown in FIG. 20. forelegs 302 and hindlegs 304 are swingably provided on the body 300 of the model race horse. Each foreleg 302 has a thigh 306, a leg 308 and a foot 310. The thigh 306 is pivoted to the body by a pivot pin 312. The leg 308 is pivoted to the thigh 306 by a pivot pin 314. The foot 310 is pivoted to the leg 308 by a pivot pin 316. The thigh 306 and the foot are interconnected by an interconnection rod.

Each hindleg 304 has a thigh 320, a leg 322 and a foot 324. The thigh 320 is pivoted to the body 300 by a pivot pin 326. The thigh 320 and the leg 322 are pivoted to each other by a pivot pin 328. The thigh 322 and the foot 324 are formed in one-piece. The thigh 300 and the leg 322 are interconnected to each other by an interconnection rod 330.

The forelegs 302 and the hindlegs 304 are swung by the first drive shaft 272. The first drive shaft 272 is extended into the body 300, and a worm gear 332 is disposed on the upper end of the first drive shaft 272. The worm 32 is in mesh with the worm wheel 334, and the worm wheel 334 and a wheel 336 which is coaxial with the worm wheel 334 are in mesh with a wheel 338. The pin 338*a* of the wheel 338 is extended sidewise, and a disc member 340 is fastened conically to the forward end of the pin 338*a*.

Figure 21:
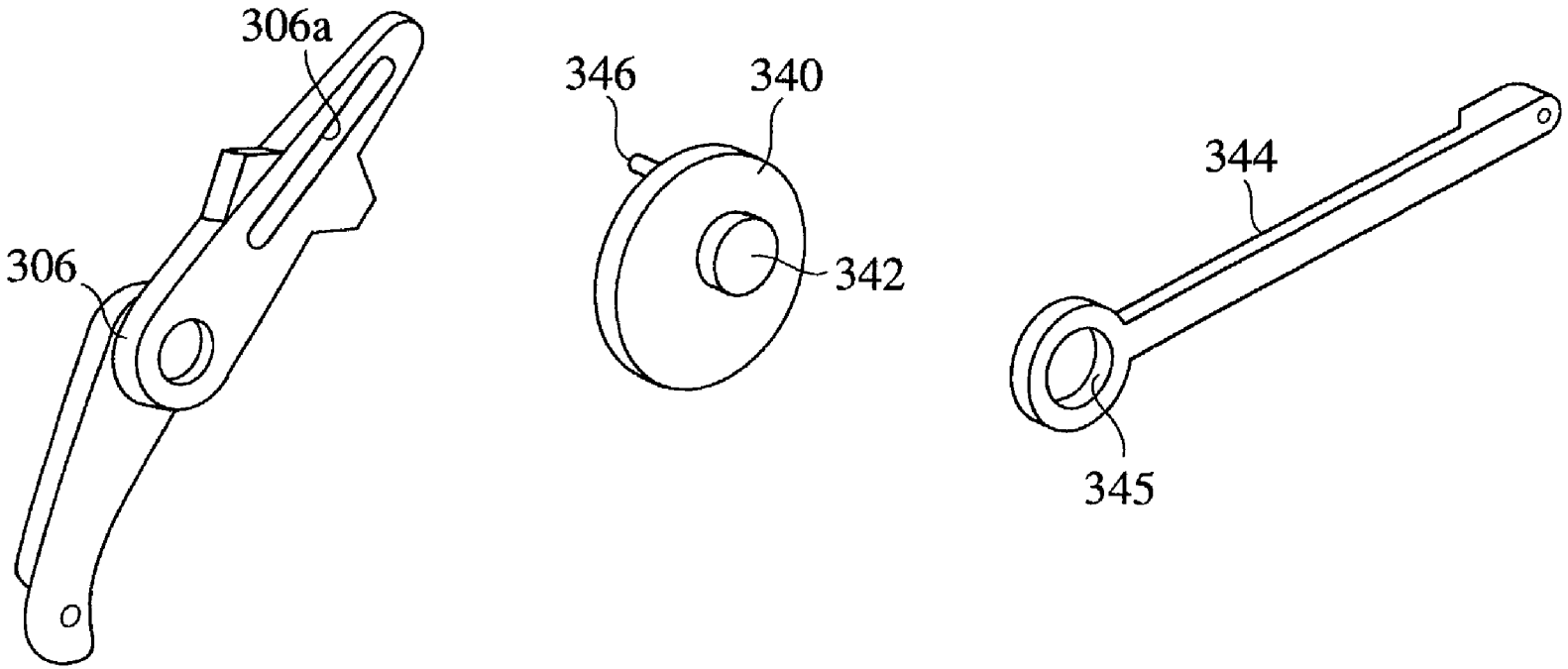
FIG. 21 is a perspective view of the race horse, which explains a part of its mechanism.

As shown in FIG. 21, a short cylindrical hub 342 is disposed at an eccentric position of the surface of the disc member 340. A circular opening 345 formed in one end of the interconnection rod 344 is rotatably engaged with the hub 342. The interconnection rod 344 is extended backward from the hub 342 and has the rear end pivotally connected to an upper part of the thigh 320 of the rear leg 304.

Thus, when the disc member 340 is rotated on the axial line of the shaft 338*a*, the interconnection rod 344 is reciprocated, vertically swinging, and the thigh 320 of the hindleg 304 is swung to-and-fro on the pivot pin.

An engagement pin 346 is projected from a peripheral part of the backside of the disc member 340. A slot 306*a* is formed in a part of the thigh 306 of the foreleg 302 on the side of the body 300. The engagement pin 346 of the disc member 340 is engaged in the slot 306*a*. A pin press plate 348 for pressing the engagement pin 346 engaged in the slot 306*a* is pivoted to the thigh 320. The substantial center of the pin press plate 348 is interconnected to the end of the thigh 320 by a spring 349 and to the end of the leg 308 by a connection rod 347.

Accordingly, when the disc member 340 is rotated on the axial line of the shaft 338*a*, the thigh 320 is swung on the engagement pin 346 in the slot 306*a*, and the leg 308 and the foot 310 are swung to-and-fro by the connection rod 347.

A positional relationship between the hub of the disc member 340 and the engagement pin 346, and a positional relationship between the foreleg 302 and the hindleg 304 are set so as to make the swinging motions simulate the running motions of actual horse legs.

Then, a constitution of a model jockey 350 will be explained with reference to FIGS. 22 to 25. FIGS. 22 to 25 show views of the opposite side of the model jockey 350 as shown in FIGS. 17 and 20.

Figure 23:
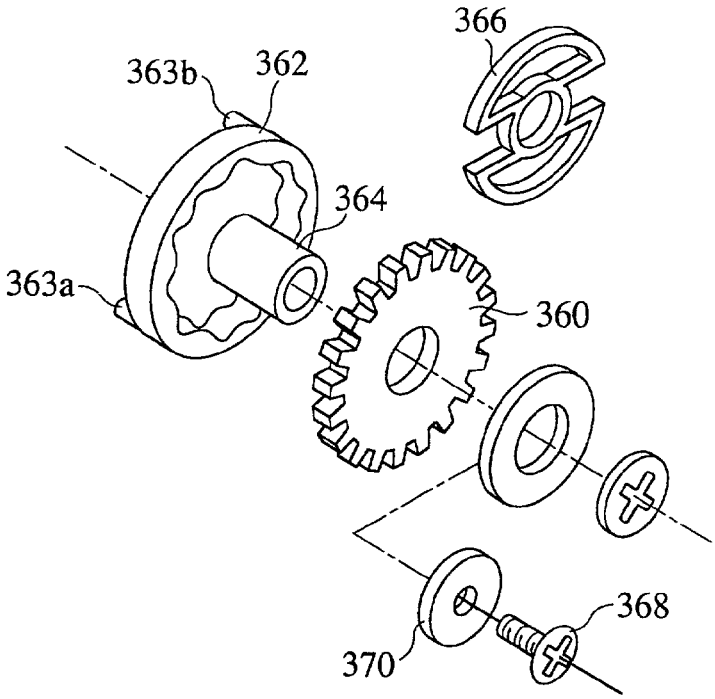
FIG. 23 is a perspective view of the model race horse, which explains a part of its mechanism.

The model jockey 350 is driven by the second drive shaft 274. The worm gear 352 disposed on the second drive shaft 274 is in mesh with the worm wheel 354, and the drive wheel 356 which is coaxial with the worm wheel 354 is in mesh with a driven wheel 360 through an intermediate wheel 358. As shown in FIG. 23, the driven wheel 360 is rotatably pivoted on a pin 364 which is integral with the disc member 362. The disc member 362 is rotatably pivoted to the body 300 of the model race horse 110. Two pins 363*a*, 363*b* are projected from the side of the disc member 362 opposite to the driven wheel 360 at diametrically opposed peripheral positions.

A friction piece 366 is disposed between the driven wheel 360 and the disc member 362. The driven wheel 360 is urged to the side of the disc member 362 through a washer 370 by a screw 368 screw-engaged with the pin 364.

Accordingly rotations of the driven wheel 360 are transmitted to the disc member 362 through frictional forces of the friction piece 366. When the resistance of the disc member 362 is larger than the frictional force of the friction member 366, the driven wheel 360 idles.

An arm 372 of the model jockey 350 has the proximal end thereof swingably pivoted to the shoulder of the model jockey 374 by a pivot pin 376. A pin 377 is projected from the proximal end at the outer periphery of the pivot pin 376. A lever member 380 has a lower end portion pivoted by a pivot pin 378 to a middle part of the body 374 below the pivot pin 376. On the upper end of the lever member 380 there is provided an engagement surface 382 which engages with the pin 377.

The upper end of a rod member 384 is swingably engaged to the lever member 380 at a position which is nearer to the pivot pin 376 at the middle of the lever member 380. The rod member 384 is extended to the vicinity of the disc member 362 below.

The rod member 384 has the lower end pivoted to a forward end of a lever member 388 having the rearward end pivoted to the body 300 by a pivot pin 386 which is coaxial with the thigh 320 of the hindleg 304.

Figure 22:
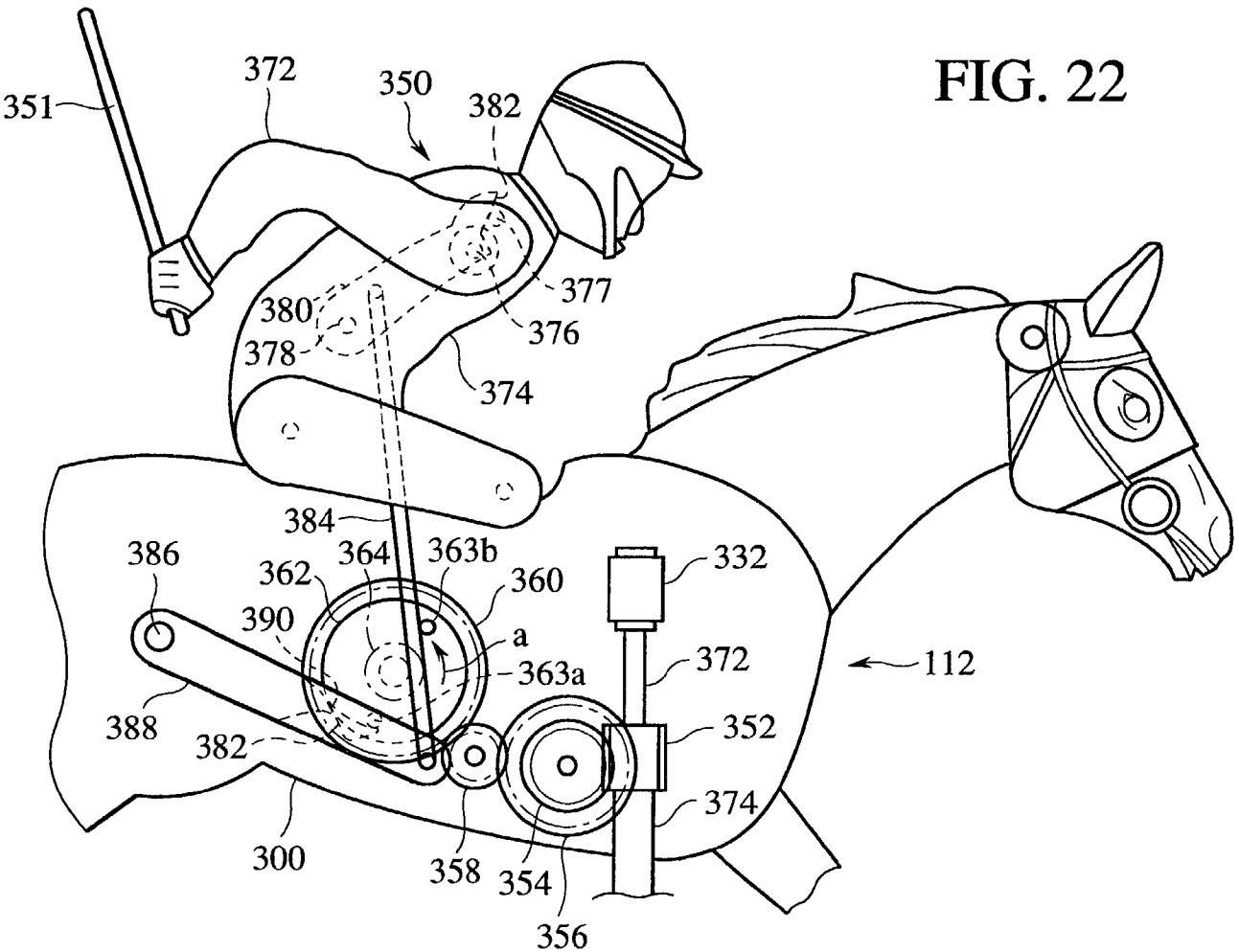
FIG. 22 is a view of a constitution of the race horse of the horse race game device in a state in which the model jockey is swinging the whip upward.
Figure 24:
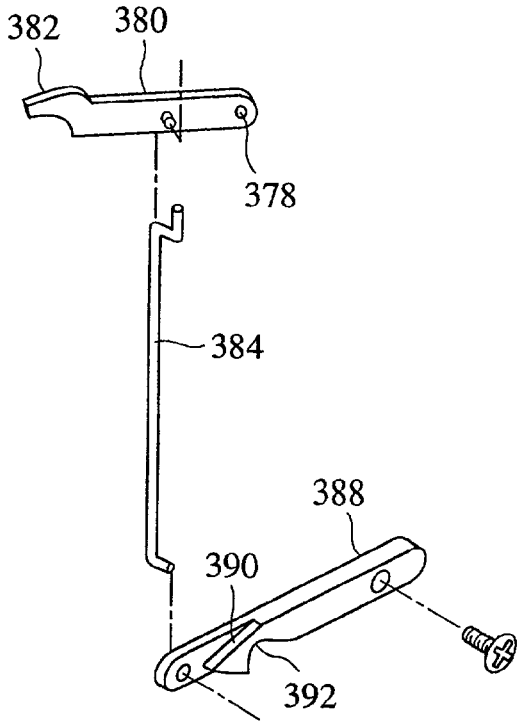
FIG. 24 is a perspective view of the model race horse, which explains a part of its mechanism.

FIG. 24 is broken perspective view of the opposite sides of the lever member 380, the rod member 384 and the lever member 388 shown in FIG. 22. As seen in FIGS. 22 and 24, a large radius of curvature arc-shaped upward cam surface 390 is formed in a step on the surface of the lever member 388 on the side of the disc member 362. A downward recess 392 is formed in the underside of the cam surface 390. The recess 392 is in the shape of a small radius of curvature arc.

FIG. 22 shows a state of the model jockey 350 swinging up a whip 351. In this state, a hand 372 tends to rotate counter-clockwise on the pivot pin 376 due to its own weight. This rotation force is transmitted to the lever member 388 through the engagement of the pin 377 and the engagement surface 382 and further to the lever member 388 from the lever member 38 through the rod member 384. Accordingly the lever member 388 is urged so as to swing upward on the pivot pin 386 of the lever member 388. The upward swing of the lever member 388, however, is prohibited by engagement of the pin 363*a* with the cam surface 390, and the hand is held at the upper position as shown.

At this time, the disc member 362 has been rotated counter-clockwise as indicated by the arrow (a), and immediately after the shown state, the pin 363*a* is disengaged from the cam surface 390. Then the lever member 388 is free to swing, and the hand 372 is swung downward on the pivot pin 386 by its own weight, simulating a whipping motion. Simultaneously therewith, the lever member 388 is swung upward, and then at its upper position the pin 363*b* is brought into engagement with the cam surface 390. Thereafter, as the disc member 362 is rotated, the lever member 388 is pushed downward. Accordingly the hand 372 is swung upward on the pivot pin 386, and again the whip is swung up as shown in FIG. 22.

The same operation is repeated. That is, by continuously rotating the disc member 362 in the direction of the arrow (a), the hand 372 repeats the upward and the downward motions, which simulate whipping motions.

Figure 25:
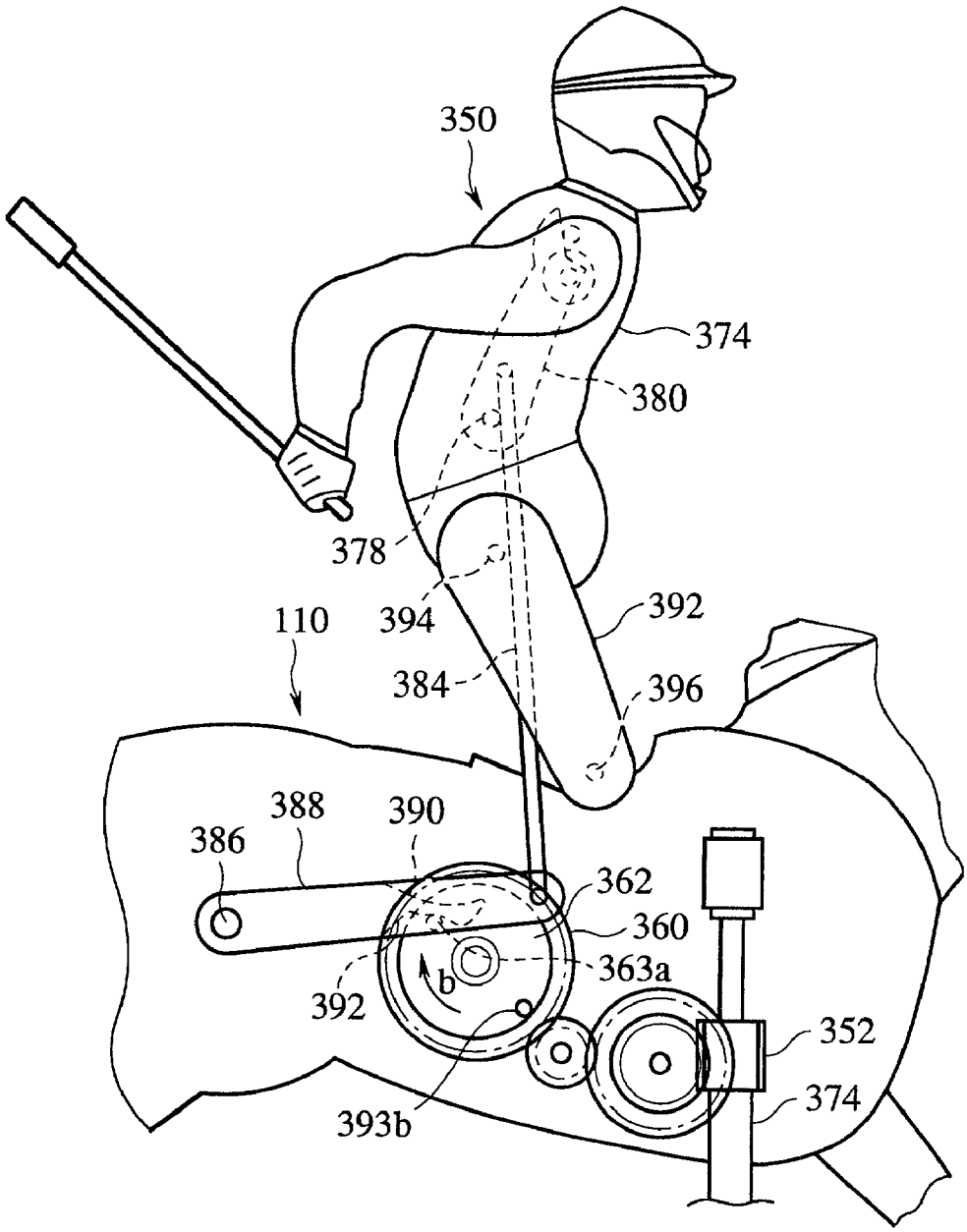
FIG. 25 is a view of a constitution of the race horse of the horse race game device in a state in which the model jockey is standing.

By rotating the second drive shaft 274 in an opposite direction, as shown in FIG. 25, the model jockey 350 is caused to rise on a model race horse 110.

In this case, the disc member 362 is rotated in the direction of the arrow (b) which is opposite to the direction of rotation for the whipping. Either of the pins 363*a*, 363*b* is brought into engagement into the recess 392 from below which is positioned downward of the cam surface 390, and the lever member 388*i* is swung further upward than in the whipping motion. Consequently, the pivot pin 386 is pushed further upward through the rod member 384 and the lever member 380, and the model jockey 350 rises as shown in FIG. 25.

The body 374 and the leg 392 of the model jockey 350 are swingably connected by a pivot 394, and a lower end portion of the leg 374 is swingably connected to the body 300 of the model race horse 350 by a pivot 396.

In the sates shown in FIG. 25, the pins 363*a*, 363*b* are in engagement in the small of radius curvature recess 392, and accordingly the lever member 388 cannot be pushed up to be swung further in the direction of the arrow (b). That is, the rotation of the disc member 362 is prohibited, but the disc member 362 and the driven wheel 360, which are in engagement with each other through the friction member 366 as described above, slide with respect each other, which permits the driven wheel 360 to continuously rotate. Accordingly, the model jockey 350 can retain its rising posture as shown.

When the second drive shaft 274 is rotated in an opposite direction to rotate the driven wheel 360 and the disc member 362 again in the direction of the arrow (a), the pins 363*a*, 363*b* are disengaged from the recess 392 and are brought into engagement with the upper cam surface 390 and are returned to their original state of FIG. 22.

As described above, in the model race horse and the model jockey of the present embodiment, one of the rotary magnets is rotated, whereby the model race horse repeats opening and closing the legs to simulate running of an actual race horse, and the model jockey simulates motions of an actual jockey corresponding to the opening and closing of the legs of the model race horse. The other of the rotary magnets is rotated, whereby the model jockey can simulate the whipping motions and the winning pose.

(Second Embodiment)

The horse race game device according to a second embodiment of the present invention will be explained with reference to FIGS. 26 to 33. The same or similar members of the present embodiment as or to those of the horse race game device according the first embodiment are represented by the same reference numbers not to repeat or to simplify their explanation.

(General Appearance of the Horse Race Game Device)

Figure 26:
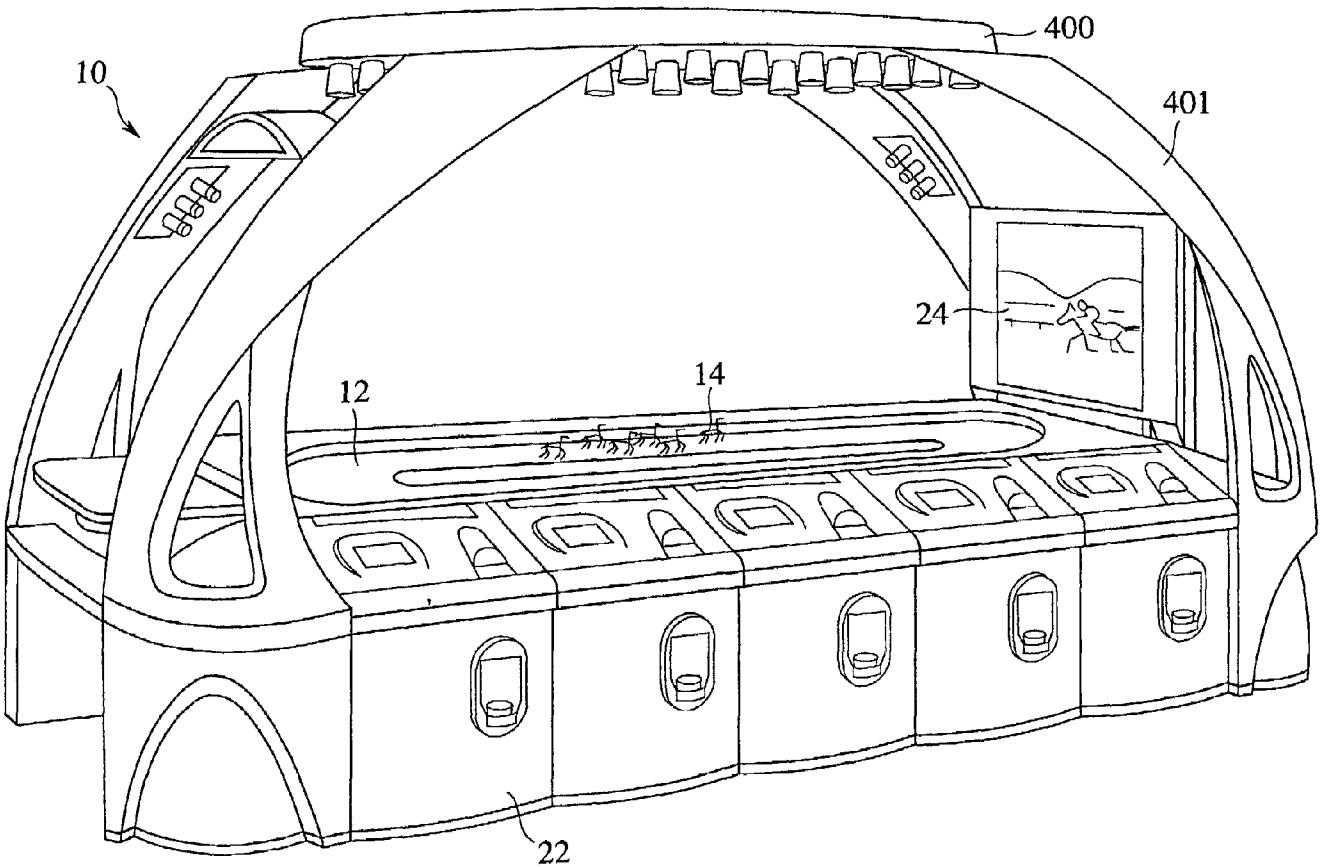
FIG. 26 is a view of a general appearance of the horse race game device according to a second embodiment of the present invention.

FIG. 26 shows a general appearance of the horse race game device.

A loop track 12 for horse races is disposed at the center of a horse race game device 10. Six model race horses 14 run along the track 12. A gate (not shown) is disposed in the track 12, and is advanced to a start position when a race is started.

Ten satellites 22 are disposed around the track 12. Five of the ten satellites 22 are disposed on each of the longer sides of the track 12.

On one of the shorter sides of the track 12 there is disposed a large projector 24 for displaying images of situations of a race. On both side of the large projector 24 there are disposed speakers (not shown) for real time broadcasting, fanfare, BGM, etc.

Above the track 12 there is disposed a track lighting unit 400 for lighting the track 12 and the model race horses 14. The track lighting unit 400 has a shape of the track and is supported by support rods 401 erected on the four corners of the track 12.

(General Structure of the Horse Race Game Device)

Figure 27:
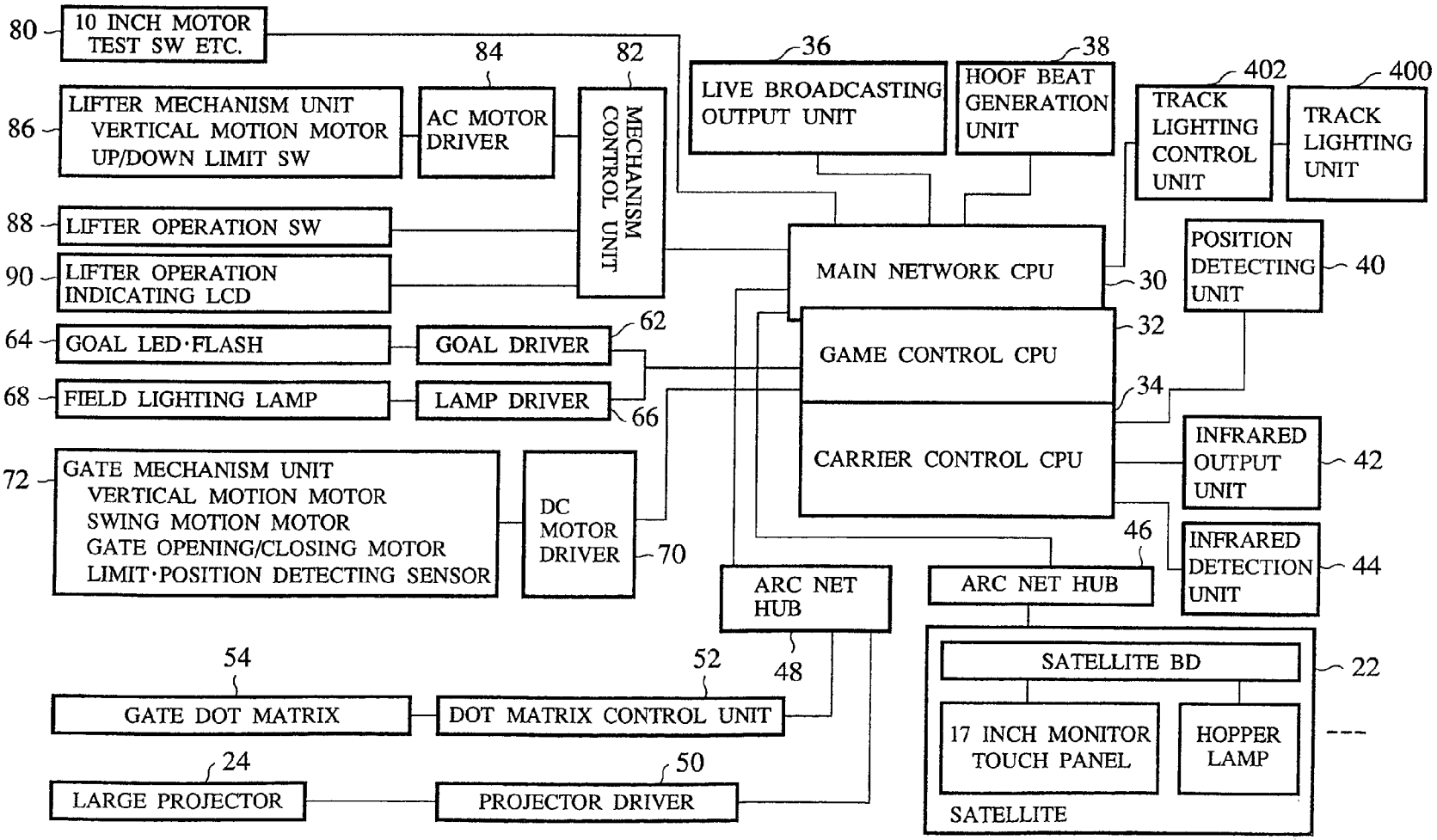
FIG. 27 is a block diagram of a general constitution of the horse race game device according to the second embodiment of the present invention.

FIG. 27 shows a general structure of the horse race game device.

In place of the lighting lawn 60, the light lawn driver 58, the lighting lawn control unit 56, the track lighting unit 400 for illuminating the track 12 and the model race horses 14 and a track lighting control unit 402 for controlling the track lighting unit 400 are provided. The rest structure of the present embodiment is the same as the structure of the first embodiment.

The track lighting control unit 402 is connected to a main network CPU 30. The track lighting unit 400 lights the track 12 to produce a lighting effect of making the track 12 outstanding, or traces a leading model race horse 14 by light for lighting effect.

(Track Lighting Unit (Part 1)

FIG. 28 shows a structure of the track lighting unit 400 of the horse race game device 10.

Figure 28A:
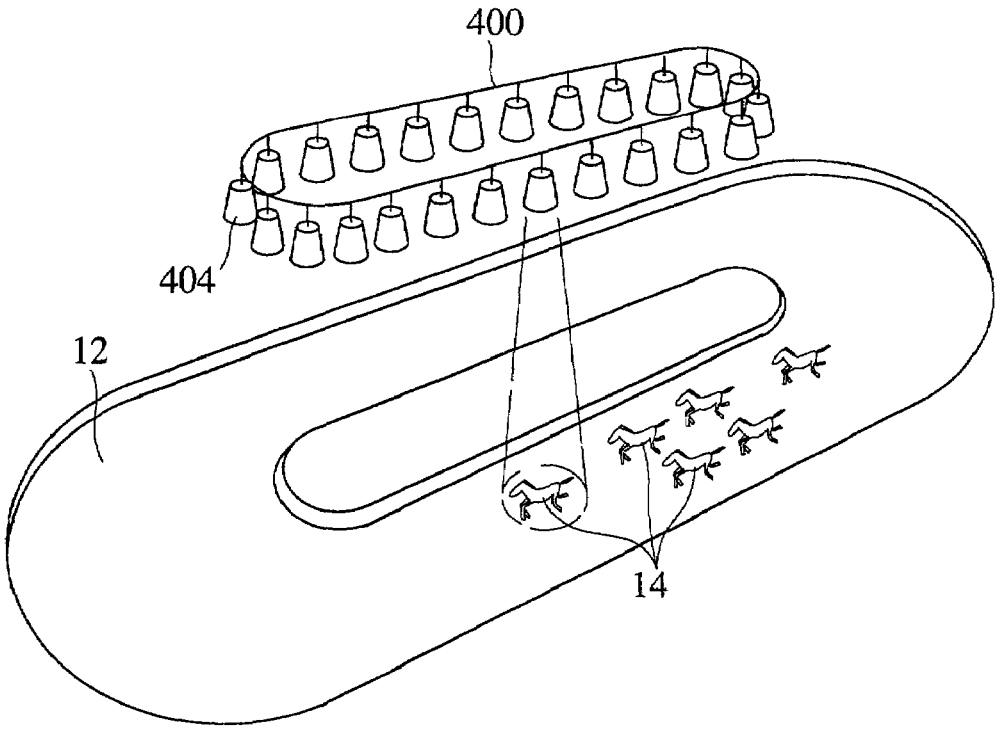
FIG. 28 is views of one example of the track lighting unit of the horse race game device, which shows a structure thereof.
Figure 28B:
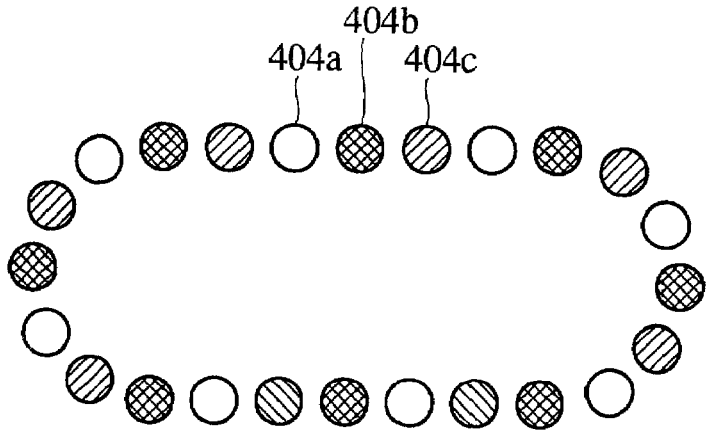

In the present embodiment, as shown in FIG. 28A, the track lighting unit 400 is above the track 12. A number of lamps 404 are arranged in a shape of the track. The respective lamps 404 are directed so as to light respective parts of the track 12, and when the lamps 404 are sequentially turned on, a spot light goes around the track 12.

A number of lamps 404 may be lamps of lighting colors suitably arranged. As exemplified in FIG. 28B, a white lamp 404*a*, a red lamp 404*b* and a blue lamp 404*c* are sequentially arranged, and when a number of lamps 404 are sequentially turned on, a lighting spot circulates along the track 12 in the sequential colors. When a number of lamps are turned on in accordance with proceedings of a horse race game, a lighting spot traces a leading model race horse of the horse race game.

A number of lamps 404 may be provided by a plurality of sets each of three light primary colors, a red lamp, a green lamp and a blue lamp. In this case, the lamps 404 are controlled to be turned on by one set of three lamps of the light three primary colors. By controlling turning on the sets of the three lamps, lighting of a required color tone can be obtained.

One example of the lighting control by the track lighting unit 400 will be explained.

Until a game race is started, the lighting is controlled to effectively induce game players to participate in the game race and make the atmosphere for a betting time. For example, the lawn-colored track 12 is illuminated light, or the lighting is controlled to circulate a spot light. The track 12 may be made white to turn to a required color by lighting by the track lighting unit 400. For example, colors can be freely changed to a bright lawn color, brown of the gate or others, depending on race situations.

When the model race horses 14 are gathered near the gate to start the race, the track lighting unit 400 lights concentratedly a neighborhood of the gate.

When the game race is started, the track lighting control unit 400 turns on the lamp 404 corresponding to a position of a currently leading model race horse detected by the position detecting unit 40 to spot the leading model race horse.

When the game race is finished, lighting is controlled to effect excitation about a result of the game race. For example, the entire track 12 is flashed, or a slight spot goes around. When a winning model race horse 14 makes a winning run around the track 12, the track lighting unit 400 spotlights, tracing the model race horse on the winning run.

Thus, the track lighting unit of the present embodiment can light the total track for the model race horses to run along, spotlight a running model race horse in addition to images, and sounds and voices, as of BGM, hoofbeats, etc., whereby the race can be further impressive.

(Track Lighting Unit (Part 2))

Figure 29:
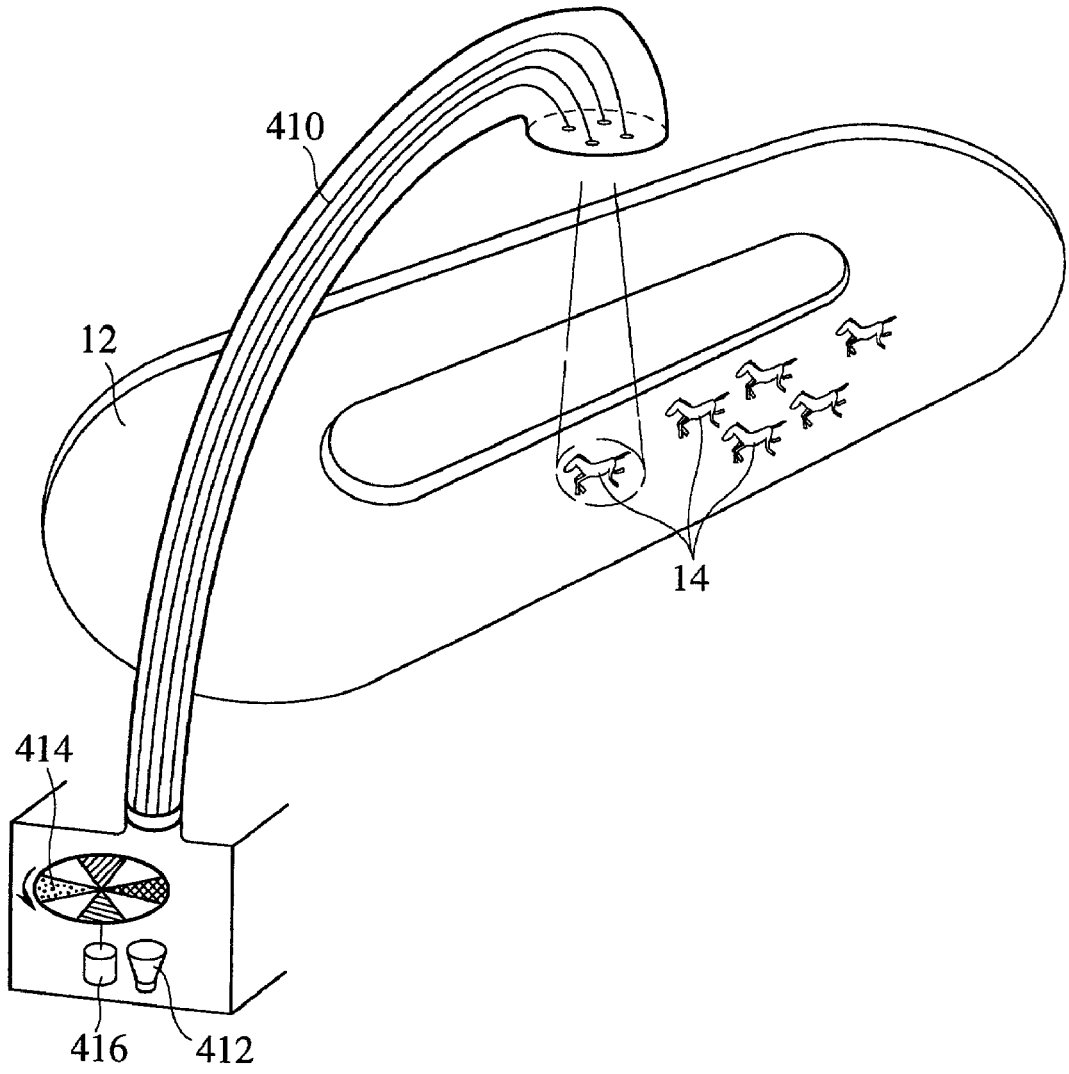
FIG. 29 is a view of another example of the track lighting unit of the horse race game device, which shows a structure thereof.

FIG. 29 shows another example of the track lighting unit 400 of the horse race game device 10.

The present example, a track lighting arm 140 comprises a plurality of fibers. As shown in FIG. 29, the track lighting arm 410 is extended above the track 12 from a corner. The forward end of the track lighting arm 410 is freely driven by drive means (not shown) to freely change lighting directions.

A lamp 412 is disposed on the other end of the track lighting arm 410. A circular filter 414 is disposed between the track lighting arm 410 and the lamp 412. The filter 414 is rotated by a motor 416. Light of the lamp 412 is incident on the other end of the track lighting arm 410 through the filter 414. The filter 414 is rotated by the motor 416 to change intensities and color tones of light to be illuminated to the track 12.

One example of control of the lighting of the track lighting unit 400 will be explained.

Until a game race is started, lighting is conducted to effect inducing players to participate in the game race and a betting time before the game race is started. For example, forward end of the track lighting arm 410 is swivelled to light so that a spot light circulates along the track.

When the game race is started, the track lighting control unit 402 moves the forward end of the track lighting arm 410, based on a position of a current leading game race 14 detected by a position detecting unit 40, and spotlights the leading race horse.

When the game race is finished, the lighting is conducted to effect excitation about a race result. For example, the forward end of thee track lighting arm 410 is swivelled with the filter 414 being rotated to change colors so as to circulate a spot light with colors of the track 12 being changed. When a winning model race horse makes a winning run along the track 12, the track lighting arm 400 traces the model race horse on the winning run, spotlighting the same.

Thus, the track lighting unit of the present embodiment can spotlights a running model race horse in addition to images, and sounds and voices, as of BGM, hoofbeats, etc., whereby the race can be further impressive.

(Track Lighting Unit (Part 3))

Figure 30:
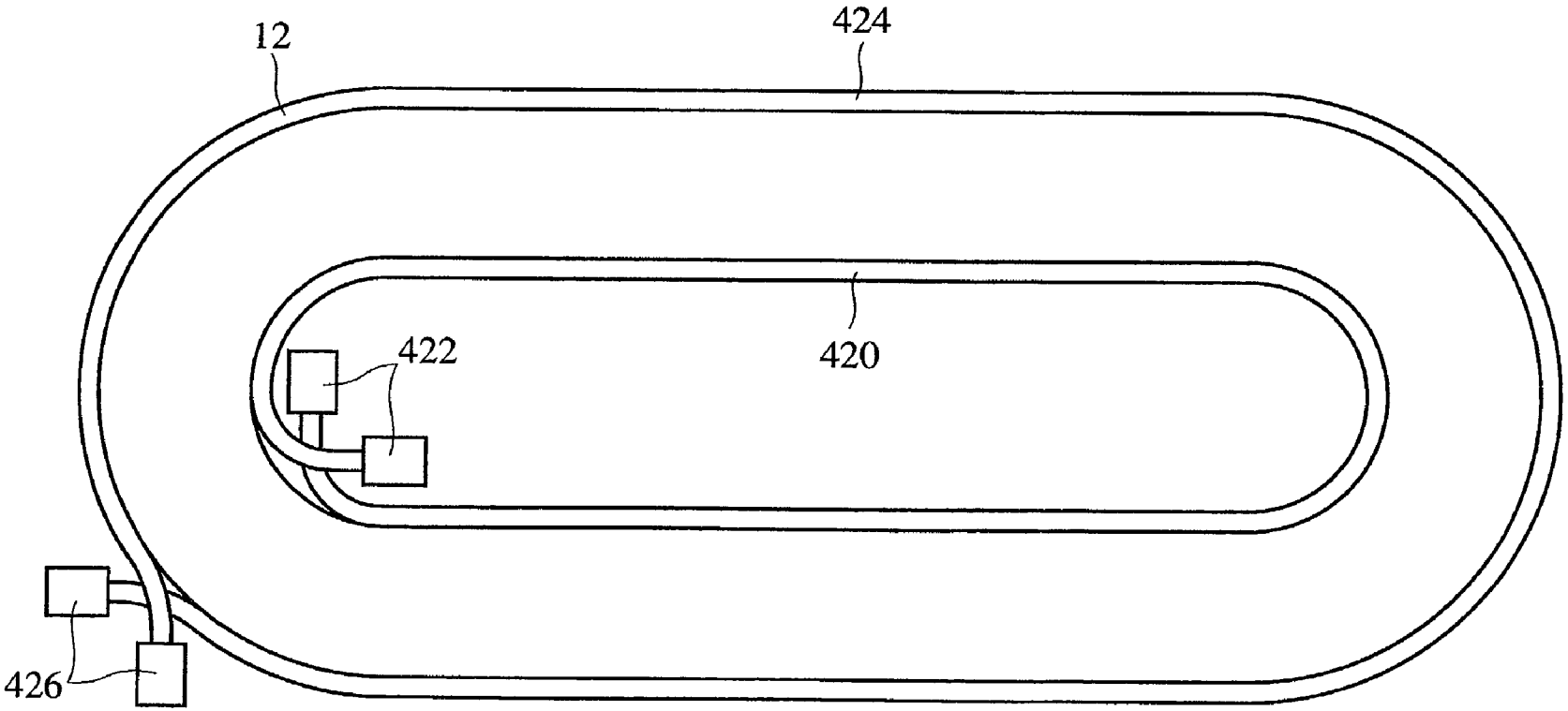
FIG. 30 is a view of further another example of the track lighting unit of the horse race game device, which shows a structure thereof.

FIG. 30 shows further another example of the track lighting unit of the horse race game device 10.

In the present example, a fiber 420 and a fiber 424 which horizontally emit light are provided respectively along the outer circumference and the inner circumference of the track 12. Light sources 422 are provided on the ends of the fiber 420, and light sources 426 are provided on the ends of the fiber 424.

Light from the light sources 422, 426 are emitted at a side thereof to light the track 12. The light sources 422, 426 are controlled by the track lighting control unit 402. Intensities and color tones of the light sources 422, 426 are changed to change intensities and color tones of the illuminating light.

According to the present example of the track lighting unit, color tones of the track can be freely changed corresponding to proceedings of a race of the horse race game in addition to images, and sounds and voices, such as BGM, hoofbeats, etc., whereby the race can be impressive.

The present example of the track lighting unit may be singly used or may be more effectively used together with the example of the track lighting unit (Part 1) and that of the track lighting unit (Part 2).

(Satellites)

Figure 31:
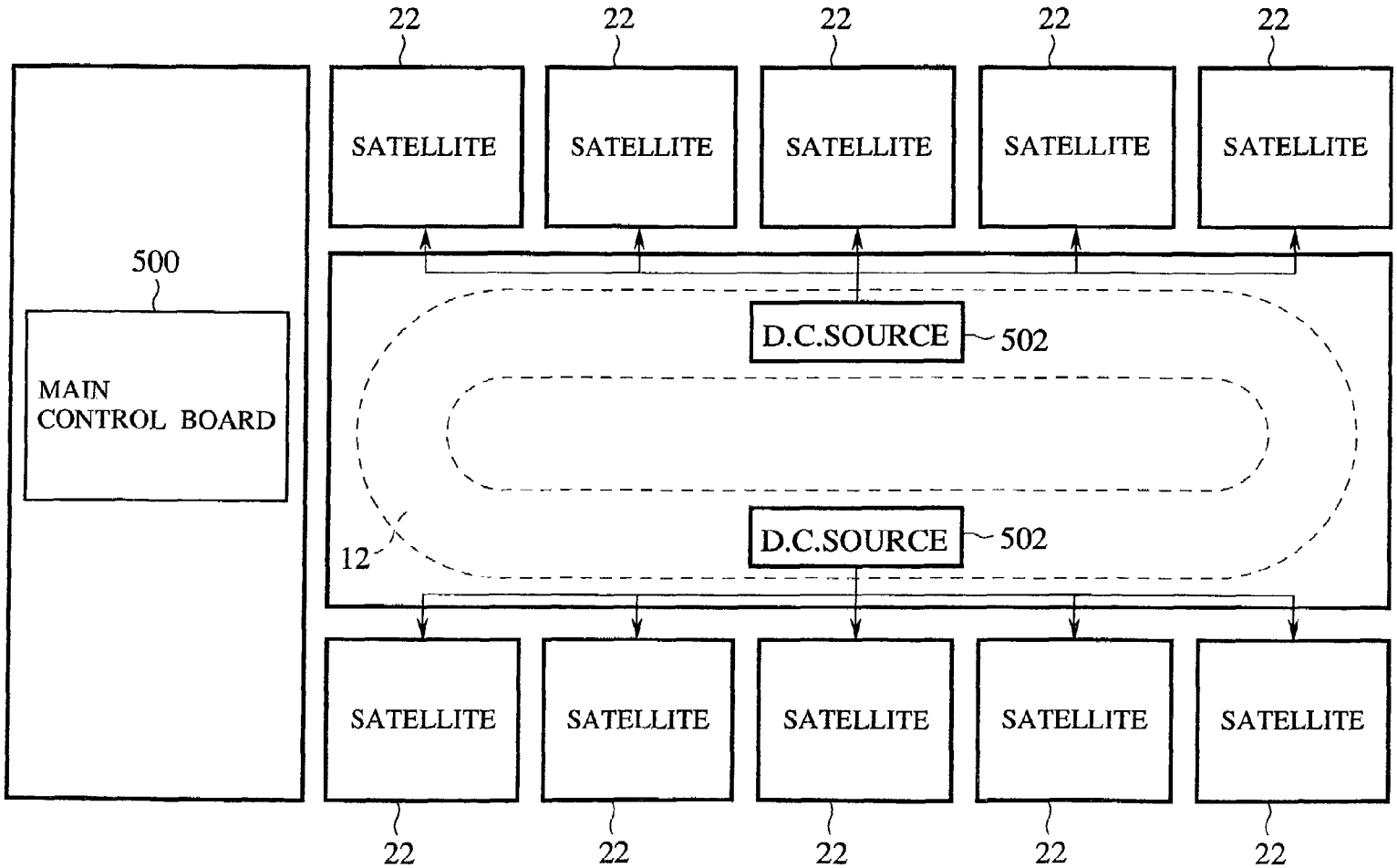
FIG. 31 is a view of a layout of the satellites of the competing game device.
Figure 32:
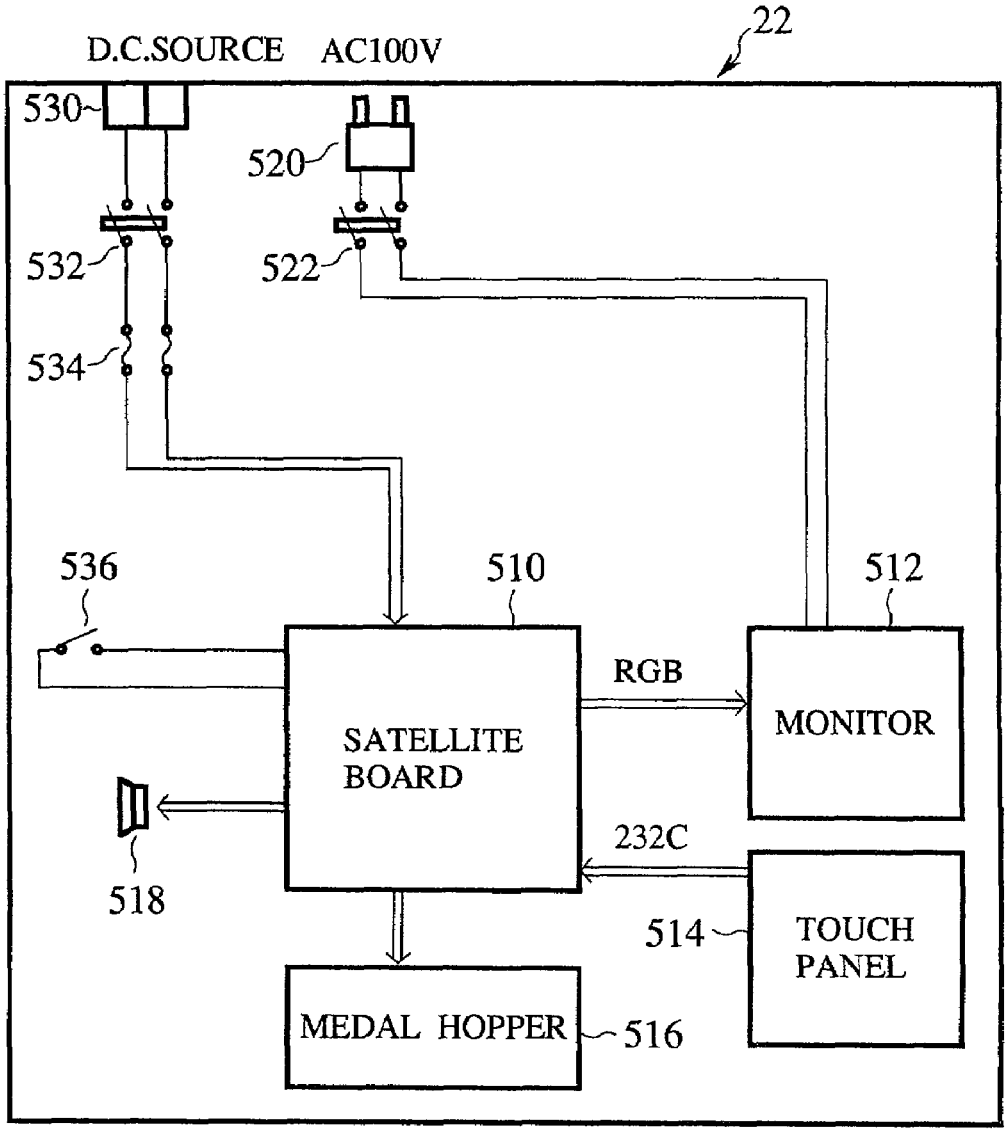
FIG. 32 is a view of an interior structure of the satellites of the competing game device.
Figure 33B:
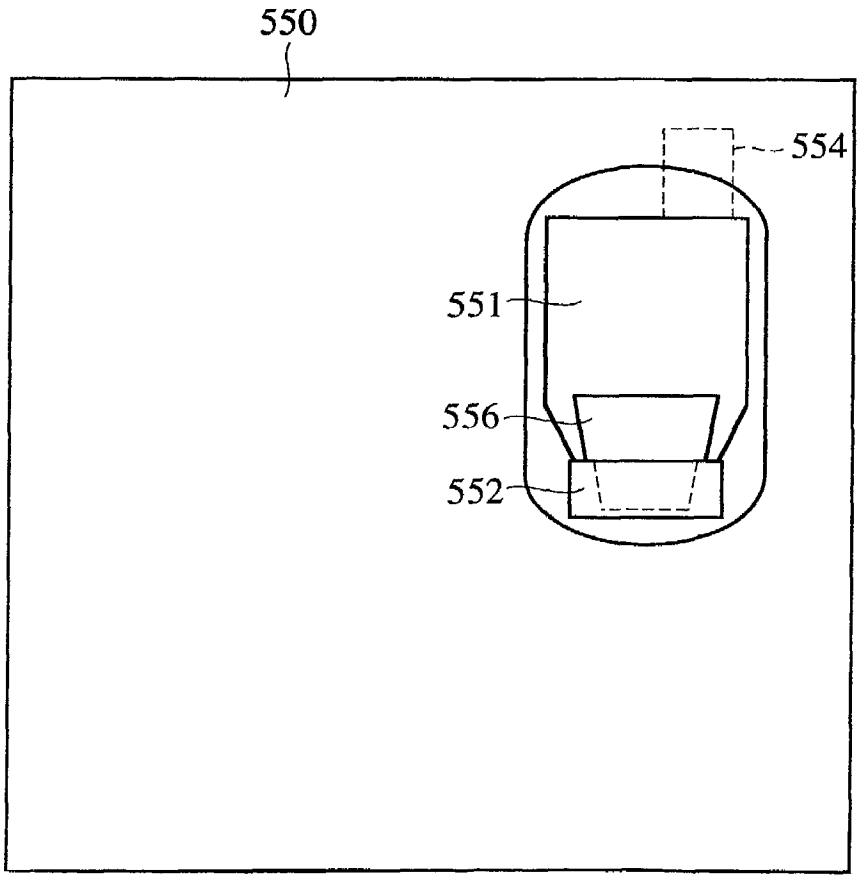
FIG. 33 is views of a structure of front panel of the satellites of the competing game device.
Figure 33A:
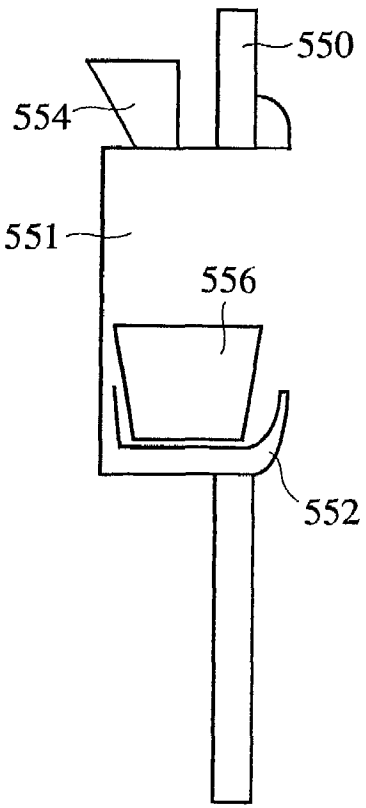

The satellites 22 of the competing game device 10 according to the present embodiment will be explained with reference to FIGS. 31 to 33. FIG. 31 is a view of a layout of the satellites 22 of the competing game device 10. FIG. 32 is a view of an interior structure of the satellites 22 of the competing game device 10. FIG. 32 is a view of an interior structure of the satellites 22. FIG. 33 is views of a structure of the front panel of each satellite 22.

The competing game device 10 according to the present embodiment includes, as shown in FIG. 31, a main control board 500 disposed below one shorter side of the track 12. Control circuits, etc. shown in FIG. 27 are mounted on the main control board 500.

Five satellites 22 are disposed on each longer side of the track 12. Direct current electric power sources 502 for the respective sets of five satellites are disposed respectively below the longer sides of the track 12. Each direct current electric source 502 supplies direct current to the five satellites 22. Although not shown, alternate current receptacles for the respective satellites 22 are disposed near the direct current electric sources 502.

FIG. 32 shows an interior structure of the satellites 22. A satellite board 510 is a circuit board with a control circuit, etc. for generally controlling the associated satellite 22 mounted on. The satellite board 510 is connected to a monitor 512 for displaying images, a touch panel 514 disposed on the surface of a monitor 512 for inputting a command of a game player, a metal hopper 516 for supplying medals, and a speaker 518 for outputting sounds and voices.

The satellites 22 require alternate electric power and direct electric power. The alternate current is supplied by a alternate current connector 520. The alternate current connector 420 is connected to the monitor 612 through an alternate current source switch 522. The alternate current connector 520 is connected to an outside alternate current receptacle.

The direct current is supplied by a direct current connector 530. The direct current connector 520 is connected to the satellite board 510 trough a direct current source switch 532 and a circuit protector 534. The direct current connector 530 is connected to an outside direct current source 502.

The alternate current source switch 522 and the direct current source switch 532 are operated by a maintenance service man and are located at a position in the associated satellite booth which does not allow a game player to operate the switches.

The alternate current source switch 522 and the direct current source switch 532 are normally on. When the main electric power source switch of the competing game device is turned on, electric power is supplied to the respective satellites 22. Alternate current power is supplied to the monitors 512, and direct current power is supplied to the satellite boards 510.

When the electric power source for the satellites 22 is turned off, the alternate current power can be shut down by simply turning off the alternate current source switch 522. However, it is impossible to immediately shut down the direct current by turning off the direct current source switch 532 because processing, e.g. reserving environmental settings, data stand-by, etc., for shut-down of the source power must be conducted in the satellite boards 510.

To this end, in the present embodiment, a door switch 536 interlocked with opening/closure of the door (not shown) of the associated satellite 22 is disposed on the associated satellite board 510. Accordingly the alternate current source switch 522 and the direct current source switch 522 are inaccessible without opening the door (not shown) of the satellite 22, so that the door switch 536 is turned off before the alternate current source switch 522 and the direct current source switch 532 are turned off.

In the present embodiment, this is made use of so that when the door is opened, and the door switch 536 is turned off, the satellite board 510 conducts the electric power source shutting-down processing. Accordingly, the subsequent turn-off of the direct current source switch 532 makes no problem, and a state before the shut-down of the electric power source can be restored when actuated again. Even in a case of a malfunction, a state of the malfunction can be accurately seen.

In place of the door switch 536, a delay switch may be used for turning off the direct current source switch 522 after a prescribed period of time. Otherwise, it is possible that a large-capacity condenser is connected to the wire for supplying the direct current to thereby delay the substantial shut-down of the source power.

In each satellite 22 of the present embodiment, the circuit protector 534 is disposed between the direct current source switch 532 and the satellite board 510. This is to the end of preventing break-down of the satellite boards 520 of the satellites, which commonly use the direct current source 502, due to excessive current from one of the satellite 22 in trouble.

FIG. 33 shows a structure of the front panel 550 of each satellite 22. A medal outlet 554 is formed in the front panel 550 of the satellite 22. A discharge opening 554 of a medal hopper 516 is formed in the top of the medal outlet 551. A cup receiver 552 for a medal cup 556 to be mounted on is formed on the bottom of the medal outlet 551.

A game player places his medal cup 556 on the cup receiver 552 to take out a medal out of the medal cup 556 as required. A medal fed through the medal hopper 516 are automatically received in the medal cup 556, which facilitate administration of the medals.

As described above, according to the present embodiment, in place of providing an electric power source for each satellite, one electric power source is commonly provided for a plurality of satellites, which contributes to installation space saving, and accordingly cost saving. According to the present embodiment, the door switch is provided to start the shut-down of the source power by turning off the door switch, whereby, at the time of the shut-down of the source power, environmental settings can be reserved, and stand-by of data, etc. are enabled, so that when reactuated, a state before the shut-down of the source power can be restored. The medal cup is provided in the medal outlet in the front panel, whereby the medal cup, which is not used while playing a game race, can be put aside, and payed-out medals can be automatically received.

In the present embodiment, the satellites are used in a competing game device, but may be applied to game devices other than competing game devices, such as those for games played by a plurality of game players, such as bingo, blackjack games, etc.

(Modification)

The present invention is not limited to the above-described embodiment and covers various modifications. For example, in the above-described embodiment, the present invention is applied to a horse race game but may be applied to various other race games, such as car races, auto-races, boat races, etc. The present invention is applicable to game devices for games played by a plurality of game players, such as bingo, blackjack game, etc.

INDUSTRIAL APPLICABILITY

The present invention is suitable for a race game device for playing a game by anticipating the winning places of moving objects, such as model horses, model cars or others, which are to be run on a track in a model horse race, model boat race, model car race, an auto race or others.

The invention claimed is:

1. A race simulator device for simulating racing moving objects on a field, comprising:

at least one operating unit for players of said race simulating device, said at least one operating unit comprising:

a game screen for displaying a bet display including a first area displaying race information to a player and a second area displaying bet buttons, said race information comprising information about simulated races;

a storing means for storing race information corresponding to a plurality of simulated races including at least the next simulated race, the next but one simulated race, and the next but two simulated race to be held;

a switch for switching race information;

a selecting means for selecting race information corresponding to any race of said plural simulated races stored in said storing means by operating said switch, said selected race information being displayed on said game screen, wherein the game screen can display race information about upcoming races including at least the next race, the next but one race, and the next but two race to be held later on said game screen even though a current race is executing; and a control system, connected to said game screen, programmed to receive an annotation input signal representing a tracing of a user message in said first area while said race information is displayed, said control system further programmed to cause the game screen to display the user message superimposed over said race information responsive to said annotation input signal, and said control system further programmed to receive a betting input signal representing a user pressing one of said bet buttons in said second area.

2. A race simulator device for simulating racing moving objects on a field, comprising:

at least one operating unit, said at least one operating unit providing an interface with said race simulator device for a respective user, said operating unit comprising:

a game screen, said game screen providing a graphical display including a first area configured to display simulated race information and a second area configured to display bet buttons corresponding to said simulated race information displayed in said first area, wherein said simulated race information relates to and can be switched among a simulated race to be immediately held and a plurality of simulated races to be held thereafter;

a storing means for storing simulated race information corresponding to a plurality of simulated races including at least the next simulated race, the next but one simulated race, and the next but two simulated race to be held;

a switch for switching simulated race information;

a selecting means for selecting simulated race information corresponding to any simulated race of said plural simulated races stored in said storing means by operating said switch, said selected simulated race information being displayed on said game screen, wherein the game screen can display simulated race information about upcoming simulated races including at least the next simulated race, the next but one simulated race, and the next but two simulated race to be held later on said game screen even though a current race is being simulated; and a control system, connected to said game screen, programmed to receive an annotation input signal tracing a user message said first area while said simulated race information is displayed, said control system further programmed to cause the game screen to display a said user message superimposed oversaid simulated race information responsive to said annotation input signal, and said control system further programmed to receive a betting input signal representing a user pressing one of said bet buttons in said second area, a speaker system configured to provide sounds to said respective user, wherein said sounds correspond to a present simulated race and positions of said moving objects.

3. A method for simulating racing moving objects around a track, comprising:

storing information related to a plurality of simulated races, including at least a current simulated race, a next simulated race, and a simulated race after next, receiving a selection input signal corresponding to a single simulated race from the plurality of races, displaying on first area of a touch screen information for said single simulated race, displaying on a second area of the touch screen a plurality of bet buttons, receiving an annotation input signal from the touch screen representing a user tracing a user message on the first area of the touch screen, displaying the user message responsive to the annotation input signal superimposed over the information on the first area of the touch screen, and receiving a betting input signal responsive to the user pressing on the second area of the touch screen.

* * * * *